US011448202B2

(12) United States Patent
Mu et al.

(10) Patent No.: US 11,448,202 B2
(45) Date of Patent: Sep. 20, 2022

(54) AUTOMATED CONTROL OF HYDRAULIC FRACTURING PUMPS

(71) Applicant: SCHLUMBERGER TECHNOLOGY CORPORATION, Sugar Land, TX (US)

(72) Inventors: Nan Mu, Sugar Land, TX (US); Bao Mi, Sugar Land, TX (US); Amal Bagulayan, Sugar Land, TX (US); James Matthews, Sugar Land, TX (US); Marcos Suguru Kajita, Houston, TX (US); Alexander Tanner Taylor, Missouri City, TX (US); Manuel Alfonso Bobadilla Larios, Stafford, TX (US); Joseph McKinney, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/963,923

(22) PCT Filed: Jan. 23, 2019

(86) PCT No.: PCT/US2019/014649
§ 371 (c)(1),
(2) Date: Jul. 22, 2020

(87) PCT Pub. No.: WO2019/147601
PCT Pub. Date: Aug. 1, 2019

(65) Prior Publication Data

US 2021/0040830 A1 Feb. 11, 2021

Related U.S. Application Data

(60) Provisional application No. 62/620,704, filed on Jan. 23, 2018.

(51) Int. Cl.
*F04B 1/00* (2020.01)
*E21B 43/12* (2006.01)
(Continued)

(52) U.S. Cl.
CPC ..... *F04B 1/00* (2013.01); *E21B 43/12* (2013.01); *E21B 43/26* (2013.01);
(Continued)

(58) Field of Classification Search
CPC .... F04B 1/00; F04B 9/02; F04B 23/04; F04B 49/00; F04B 2205/09; F04B 1/0538;
(Continued)

(56) References Cited

U.S. PATENT DOCUMENTS 10,415,562 B2 9/2019 Kajita et al.
2003/0042020 A1 3/2003 Newman
(Continued)

FOREIGN PATENT DOCUMENTS

RU 2493361 C1 9/2013
WO 2008091775 A2 7/2008
(Continued)

OTHER PUBLICATIONS

Office Action and Search Report issued in Russian Patent Application No. 2020127734 dated Nov. 24, 2021, 15 pages with English translation.
(Continued)

*Primary Examiner* — James G Sayre

(57) ABSTRACT

Methods and systems pertaining to generating a startup or other operating order of pumps of a pumping system for performing a subterranean formation fracturing operation, and/or another pumping operation, and for coordinating distribution of flow rates to the pumps for performing the pumping operation.

18 Claims, 8 Drawing Sheets

(51) Int. Cl.

| | |
|---|---|
| ***E21B 43/26*** | (2006.01) |
| ***F04B 9/02*** | (2006.01) |
| ***F04B 23/04*** | (2006.01) |
| ***F04B 49/00*** | (2006.01) |

(52) U.S. Cl.
CPC ..... *E21B 43/2607* (2020.05); *F04B 9/02* (2013.01); *F04B 23/04* (2013.01); *F04B 49/00* (2013.01)

(58) Field of Classification Search
CPC ..... F04B 17/06; F04B 49/007; E21B 43/12; E21B 43/26; E21B 43/2607; E21B 44/00
See application file for complete search history.

(56) References Cited

U.S. PATENT DOCUMENTS

| | | | | |
|---|---|---|---|---|
| 2008/0209997 | A1 | 9/2008 | Bailey et al. | |
| 2009/0053072 | A1* | 2/2009 | Borgstadt | F04B 15/02 417/17 |
| 2013/0140031 | A1 | 6/2013 | Cohen et al. | |
| 2013/0175030 | A1 | 7/2013 | Ige et al. | |
| 2013/0290064 | A1 | 10/2013 | Altamirano et al. | |
| 2017/0074074 | A1* | 3/2017 | Joseph | E21B 43/26 |
| 2018/0171759 | A1* | 6/2018 | Meyer | E21B 34/06 |

FOREIGN PATENT DOCUMENTS

| | | | | |
|---|---|---|---|---|
| WO | 2014022318 | A1 | 2/2014 | |
| WO | 2015188162 | A1 | 12/2015 | |
| WO | 2017011585 | A1 | 1/2017 | |
| WO | WO-2018052398 | A1 * | 3/2018 | F04B 23/06 |
| WO | WO-2019108177 | A1 * | 6/2019 | E21B 43/16 |

OTHER PUBLICATIONS

Decision to Grant issued in Russian Patent Application No. 2020127734 dated Apr. 20, 2022, 36 pages with English translation.
Substantive Examination issued in Saudi Arabian Patent Application No. 520412475 dated Jun. 29, 2022; 11 pages (with English translation).

* cited by examiner

AUTOMATED CONTROL OF HYDRAULIC FRACTURING PUMPS

CROSS-REFERENCE TO RELATED APPLICATIONS

This application claims priority to and the benefit of U.S. Provisional Application No. 62/620,704, titled "Automated Control of Hydraulic Fracturing Pumps," filed Jan. 23, 2018, the entire disclosure of which is hereby incorporated herein by reference.

BACKGROUND OF THE DISCLOSURE

High-volume, high-pressure pumps are utilized at wellsites for a variety of pumping operations. Such operations may include drilling, cementing, acidizing, water jet cutting, hydraulic fracturing, and other wellsite operations. In some pumping operations, several pumps (e.g., a pump fleet) may be fluidly connected to a well via a manifold and/or other fluid conduits. For example, low-pressure fluid from one or more mixers, blenders, and/or other low-pressure sources may be distributed among the pumps by the manifold and/or other fluid conduits. The same or other manifold and/or other fluid conduits may combine pressurized fluid from the pumps for injection into the well. Success of the pumping operations at a wellsite may be affected by many factors, including the ability of the pumps to maintain a predetermined operating schedule, operate at optimum efficiency levels, and maintain predetermined individual and cumulative discharge rates.

Fracturing ("frac") pump operators at the wellsite may manually start, adjust, and stop operation of each pump so as to achieve an intended rate of discharge from the pump fleet. The pump operator may manually start pumps in a predetermined order and at predetermined times to perform different operational steps. For example, while multiple pumps are operating, the pump operator may start an additional pump connected to an acid source to pump the acid down the wellbore, such as to peel off debris attached to sidewalls of the wellbore.

However, operating pumps manually by controlling corresponding gears and throttles does not lend itself to successful pump control. For example, there are human limitations of the pump operator, including lack of knowledge or experience, stress, fatigue, and inability to operate more than one pump at a time. Because of such limitations, a pump operator is unable to simultaneously operate several pumps at optimum efficiency levels and at predetermined individual and cumulative flow rates. A pump operator may also be unable to start and stop one or more of the pumps at precise, predetermined times. For example, the inability of a pump operator to engage a pump connected to a sanding-off hose early enough can result in the hose being sanded off while pumping. Such operator limitations and operating errors substantially decrease production time, jeopardize fracturing job quality, and damage pumps, hoses, and other equipment.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure also introduces a method that includes generating an operating order of pumps of a pumping system for performing a pumping operation, as well as coordinating distribution of flow rates to the pumps for performing the pumping operation.

The present disclosure introduces a method that includes generating a startup order of pumps of a pumping system for performing a subterranean formation fracturing operation, as well as coordinating distribution of flow rates to the pumps.

The present disclosure also introduces an apparatus that includes a coordinating controller capable of communicatively connecting to pump unit controllers of two or more pump units. Each pump unit controller is in communication with at least one of a variable frequency drive, an engine throttle, a gear shifter, a prime mover, or a transmission of the corresponding pump unit. The coordinating controller includes a programmable processor having a memory device, as well as an interface circuit connected to an input device. The programmable processor is operable to process coded instructions from the input device and communicate the coded instructions to at least one of the pump unit controllers. The variable frequency drive, engine throttle, gear shifter, prime mover, and/or transmission of at least one of the pump units is responsive to the coded instructions. The coded instructions may pertain to generating a startup and/or other operating order of the pump units for performing a pumping operation, and/or to coordinating distribution of flow rates to the pump units for performing the pumping operation.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
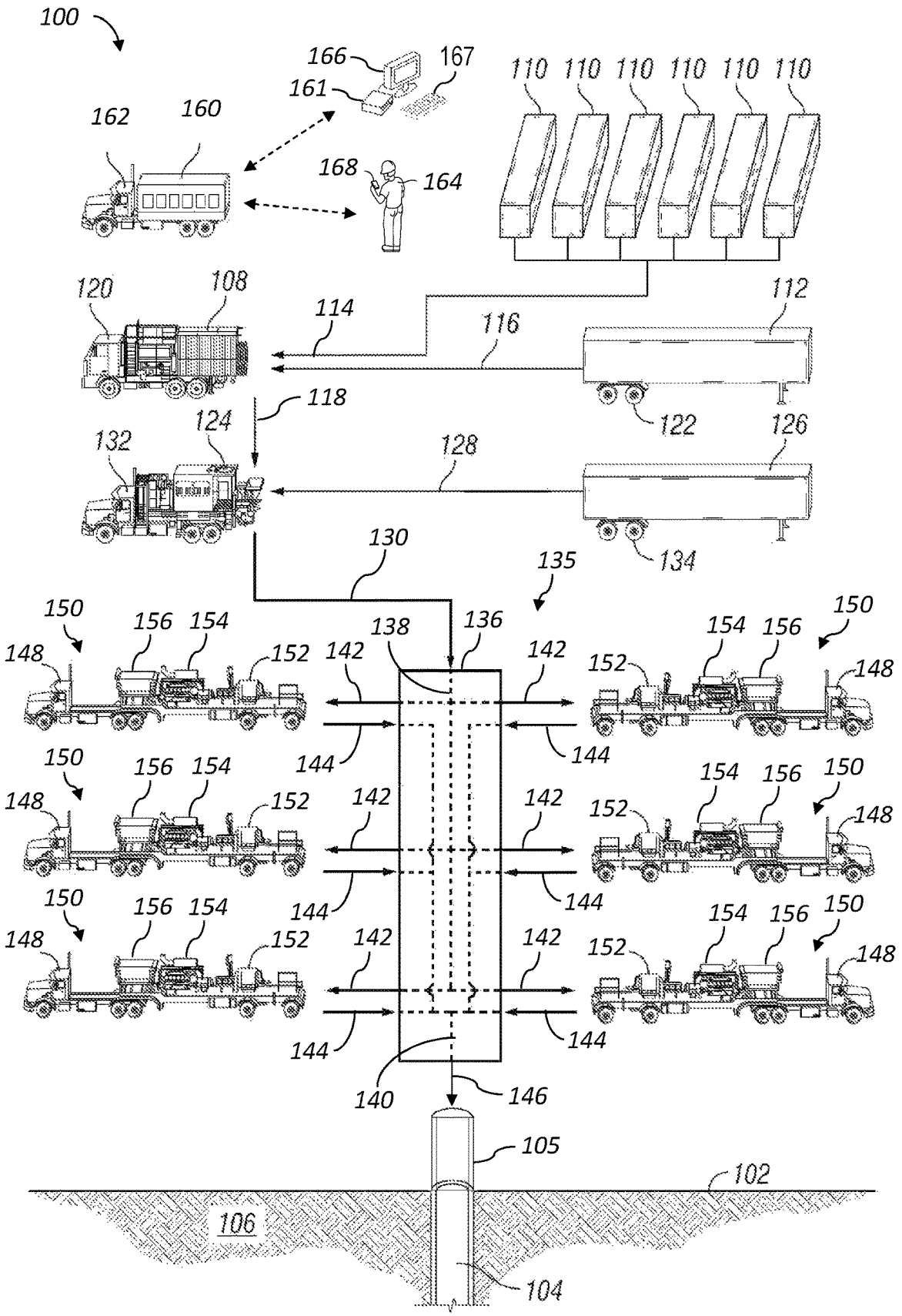
FIG. 1 is a schematic view of at least a portion of an example implementation of apparatus according to one or more aspects of the present disclosure.

It is to be understood that the following disclosure provides many different embodiments, or examples, for implementing different features or combinations of features. Specific examples of components and arrangements are described below to simplify the present disclosure. These are merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

FIG. 1 is a schematic view of at least a portion of an example environment in which a control system according to one or more aspects of the present disclosure may be utilized. The figure shows a wellsite 102, a wellbore 104 extending from the terrain surface of the wellsite 102, a partial sectional view of a subterranean formation 106 penetrated by the wellbore 104, a wellhead 108, and a wellsite system 100 comprising various pieces of equipment or components located at the wellsite 102. The wellsite system 100 may be operable to transfer various materials and additives between corresponding sources and destinations, such as for blending or mixing and subsequent injection into the wellbore 104 during fracturing operations.

The wellsite system 100 may comprise a mixing unit 108 (referred to hereinafter as a "mixer") fluidly connected with one or more tanks 110 and a container 112. The container 112 may contain a first material and the tanks 110 may contain a liquid. The first material may be or comprise a hydratable material or gelling agent, such as cellulose, clay, galactomannan, guar, polymers, synthetic polymers, and/or polysaccharides, among other examples. The liquid may be or comprise an aqueous fluid, such as water or an aqueous solution comprising water, among other examples. The mixer 108 may be operable to receive the first material and the liquid, via two or more conduits or other material transfer means (hereafter simply "conduits") 114, 116, and mix or otherwise combine the first material and the liquid to form a base fluid, which may be or comprise that which is known in the art as a gel. The mixer 108 may then discharge the base fluid via one or more fluid conduits 118.

The wellsite system 100 may further comprise a mixer 124 fluidly connected with the mixer 108 and a container 126. The container 126 may contain a second material that may be substantially different than the first material. For example, the second material may be or comprise a proppant material, such as quartz, sand, sand-like particles, silica, and/or propping agents, among other examples. The mixer 124 may be operable to receive the base fluid from the mixer 108 (via the one or more conduits 118) and the second material from the container 126 (via one or more conduits 128) and mix or otherwise combine the base fluid and the second material to form a mixture. The mixture may be or comprise that which is known in the art as a fracturing fluid.

One or more conduits 130 may communicate the mixture from the mixer 124 to a manifold 136, which may be known in the art as a missile or a missile trailer. The manifold 136 may comprise a low-pressure manifold 138 and a high-pressure manifold 140 (as well as various valves and diverters not labeled in FIG. 1). The manifold 136 may distribute the mixture to a fleet of pump units 150 via the low-pressure distribution manifold 138. Although the pump fleet is shown comprising six pump units 150, the pump fleet may comprise another number of pump units 150 within the scope of the present disclosure. The manifold 136 and the pump units 150 (and perhaps other components) collectively form a pumping system 135.

Each pump unit 150 may comprise a pump 152, a prime mover 154, and perhaps a heat exchanger 156. Each pump unit 150 may receive the mixture from a corresponding outlet of the low-pressure manifold 138, such via one or more conduits 142, and then pressurize the mixture and discharge the high-pressure mixture into a corresponding inlet of the high-pressure manifold 140, such as via one or more conduits 144. The pressurized mixture may then be discharged from the high-pressure manifold 140 into the wellbore 104, such as via one or more conduits 146, the wellhead 105, and perhaps various additional valves, conduits, and/or other hydraulic circuitry (not shown) fluidly connected between the manifold 136 and the wellbore 104.

The wellsite system 100 may also have a control center 160 comprising a controller 161 (e.g., a processing device, a computer, a PLC, etc.), which may be operable to provide control to one or more portions of the wellsite system 100 and/or to monitor health and functionality of one or more portions of the wellsite system 100. The controller 161 (also referred to herein as the coordinating controller 161) may be communicatively connected with the various wellsite equipment described herein, and may be operable to receive signals from and transmit signals to such equipment to perform various operations described herein. For example, the controller 161 may be operable to monitor and control one or more portions of the mixers 108, 124, the pump units 150, the manifold 136, and various other pumps, conveyers, and/or other wellsite equipment (not shown) disposed along the conduits 114, 116, 118, 128, 130, such as may be collectively operable to move, mix, separate, and/or measure the fluids, materials, and/or mixtures described above and inject such fluids, materials, and/or mixtures into the wellbore 104. The controller 161 may store control commands, operational parameters and set-points, coded instructions, executable programs, and other data or information, including for implementing one or more aspects of the operations described herein. Communication between the controller 161 and the various portions of the wellsite system 100 may be via wired and/or wireless communication means. However, for clarity and ease of understanding, such communication means are not depicted in FIG. 1, and a person having ordinary skill in the art will appreciate that such communication means are within the scope of the present disclosure.

A field engineer, equipment operator, or field operator (collectively referred to hereinafter as a "wellsite operator") 164 may operate one or more components, portions, or systems of the wellsite equipment and/or perform maintenance or repair on the wellsite equipment. For example, the wellsite operator 164 may assemble the wellsite system 100, operate the wellsite equipment (e.g., via the controller 161)

to perform the fracturing operations, check equipment operating parameters, and/or repair or replace malfunctioning or inoperable wellsite equipment, among other operational, maintenance, and repair tasks, collectively referred to hereinafter as wellsite operations. The wellsite operator 164 may perform wellsite operations individually or with other wellsite operators.

The controller 161 may be communicatively connected with one or more human-machine interface (HMI) devices, such as may be utilized by the wellsite operator 164 for entering or otherwise communicating the control commands to the controller 161, and for displaying or otherwise communicating information from the controller 161 to the wellsite operator 164. The HMI devices may include one or more input devices 167 (e.g., a keyboard, a mouse, a joystick, a touchscreen, etc.) and one or more output devices 166 (e.g., a video monitor, a printer, audio speakers, etc.). The HMI devices may also include a mobile communication device 168 (e.g., a smartphone, a tablet computer, a laptop computer, etc.). Communication between the controller and the HMI devices may be via wired and/or wireless communication means.

One or more of the containers 112, 126, the mixers 108, 124, the pump units 150, and the control center 160 may each be disposed on corresponding trucks, trailers, and/or other mobile carriers 122, 134, 120, 132, 148, 162, respectively, such as may permit their transportation to the wellsite surface 102. However, one or more of the containers 112, 126, the mixers 108, 124, the pump units 150, and the control center 160 may each be skidded or otherwise stationary, and/or may be temporarily or permanently installed at the wellsite surface 102.

FIG. 1 depicts the wellsite system 100 as being operable to transfer additives and produce mixtures that may be pressurized and injected into the wellbore 104 during hydraulic fracturing operations. However, it is to be understood that the wellsite system 100 may be operable to transfer other additives and produce other mixtures that may be pressurized and injected into the wellbore 104 during other oilfield operations, such as cementing, drilling, acidizing, chemical injecting, and/or water jet cutting operations, among other examples. Accordingly, unless described otherwise, the one or more fluids being pumped by a pump unit 150 may be referred to hereinafter as simply "a fluid."

Figure 2:
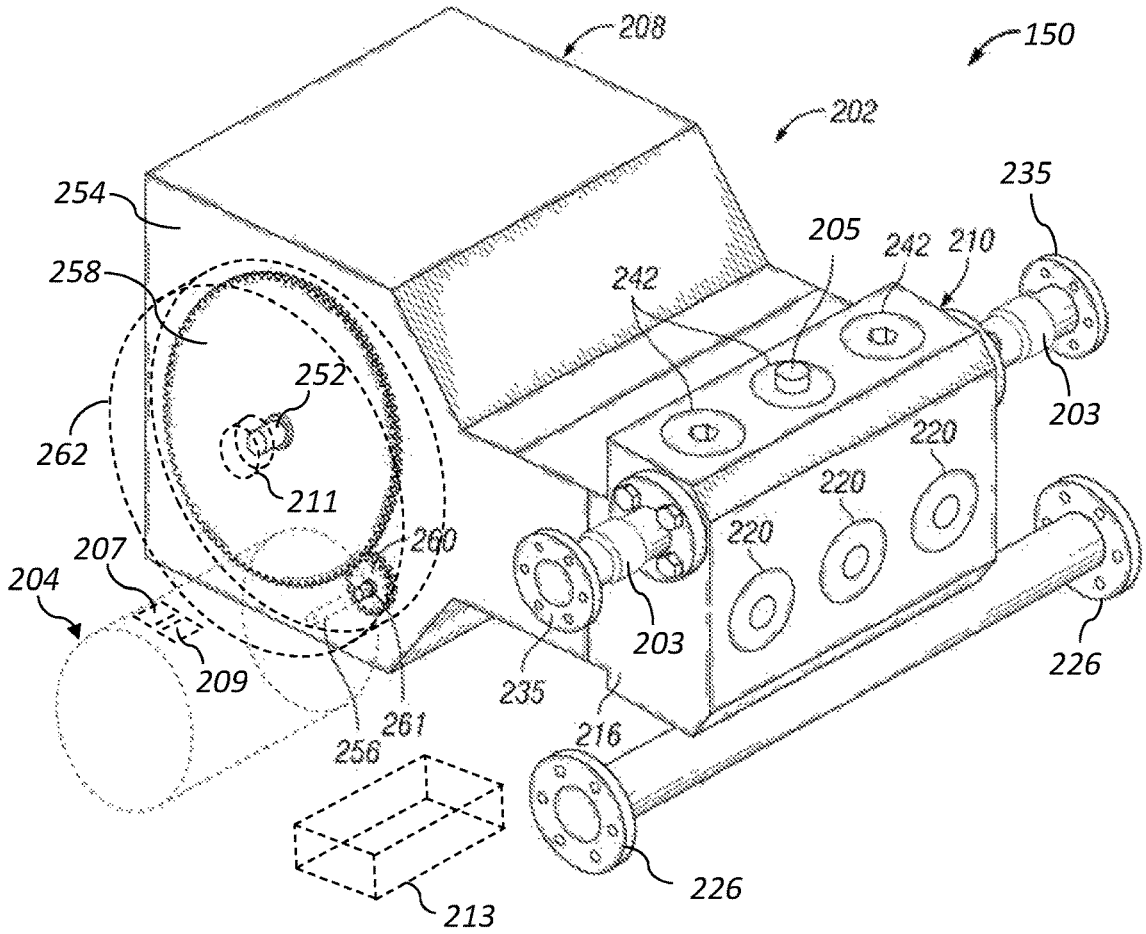
FIG. 2 is a schematic perspective view of a portion of an example implementation of the apparatus shown in FIG. 1 according to one or more aspects of the present disclosure.
Figure 3:
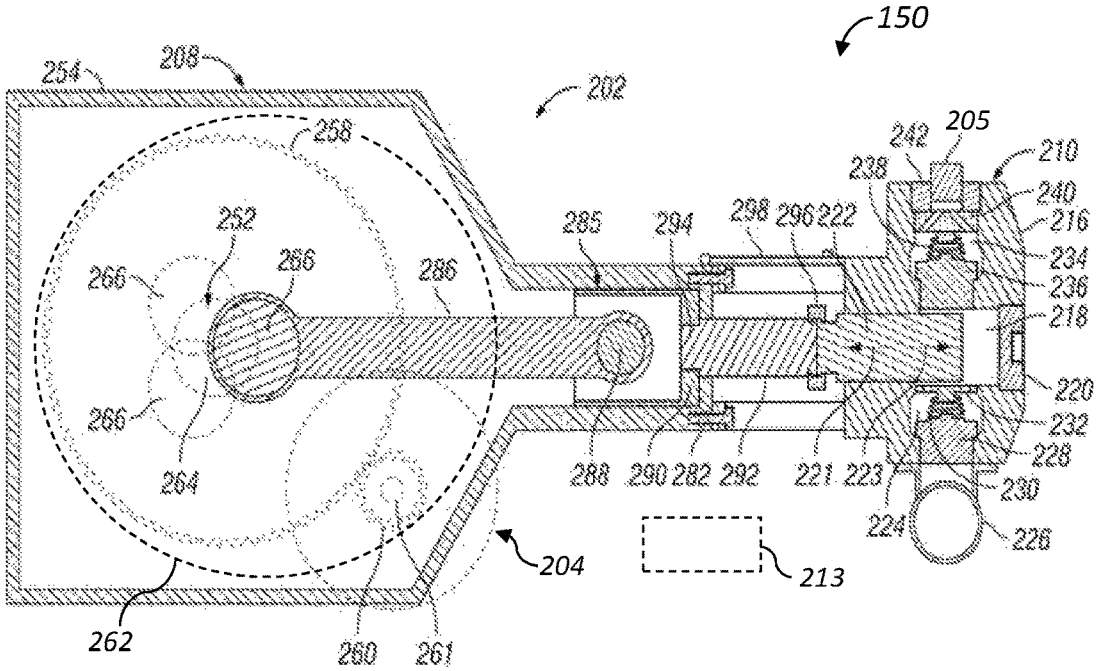
FIG. 3 is a schematic sectional view of a portion of an example implementation of the apparatus shown in FIG. 2 according to one or more aspects of the present disclosure.

FIG. 2 is a perspective schematic view an example implementation of a portion of an instance of the pump units 150 shown in FIG. 1 according to one or more aspects of the present disclosure. FIG. 3 is a side sectional view of a portion of the pump unit 150 shown in FIG. 2. Portions of the pump unit 150 shown in FIGS. 2 and 3 are shown in phantom lines, such as to prevent obstruction from view of other portions of the pump unit 150. The following description refers to FIGS. 1-3, collectively.

The pump unit 150 comprises a pump 202 operatively coupled with and actuated by a prime mover 204. The pump 202 includes a power section 208 and a fluid section 210. The fluid section 210 may comprise a pump housing 216 having a plurality of fluid chambers 218. One end of each fluid chamber 218 may be plugged by a cover plate 220, such as may be threadedly engaged with the pump housing 216, while an opposite end of each fluid chamber 218 may contain a reciprocating member 222 slidably disposed therein and operable to displace the fluid within the corresponding fluid chamber 218. Although the reciprocating member 222 is depicted as a plunger, the reciprocating member 222 may also be implemented as a piston, diaphragm, or another reciprocating, fluid-displacing member.

Each fluid chamber 218 is fluidly connected with a corresponding one of a plurality of fluid inlet cavities 224 each adapted for communicating fluid from a fluid inlet 226 into the corresponding fluid chamber 218. The fluid inlet 226 may be in fluid communication with the corresponding conduit 142 for receiving fluid from the low-pressure manifold 138. Each fluid inlet cavity 224 may contain an inlet valve 228 operable to control fluid flow from the fluid inlet 226 into the corresponding fluid chamber 218. Each inlet valve 228 may be biased toward a closed flow position by a spring or another biasing member 230, which may be held in place by an inlet valve stop 232. Each inlet valve 228 may be actuated to an open flow position by a predetermined differential pressure between the corresponding fluid inlet cavity 224 and the fluid inlet 226.

Each fluid chamber 218 is also fluidly connected with a fluid outlet cavity 234 extending through the pump housing 216 transverse to the reciprocating members 222. The fluid outlet cavity 234 is adapted for communicating pressurized fluid from each fluid chamber 218 into one or more fluid outlets 235 fluidly connected at one or both ends of the fluid outlet cavity 234. The fluid outlets 235 may be in fluid communication with the corresponding conduit 144 for communicating pressurized fluid to the high-pressure manifold 140. The fluid section 210 also contains a plurality of outlet valves 236 each operable to control fluid flow from a corresponding fluid chamber 218 into the fluid outlet cavity 234. Each outlet valve 236 may be biased toward a closed flow position by a spring or other biasing member 238, which may be held in place by an outlet valve stop 240. Each outlet valve 236 may be actuated to an open flow position by a predetermined differential pressure between the corresponding fluid chamber 218 and the fluid outlet cavity 234. The fluid outlet cavity 234 may be plugged by cover plates 242, such as may be threadedly engaged with the pump housing 216.

During pumping operations, portions of the power section 208 rotate in a manner that generates a reciprocating linear motion to move the reciprocating members 222 longitudinally within the corresponding fluid chambers 218, thereby alternatingly drawing and displacing the fluid within the fluid chambers 218. With regard to each reciprocating member 222, as the reciprocating member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the biasing member 230, thus actuating the fluid inlet valve 228 to an open flow position to permit the fluid from the fluid inlet 226 to enter the corresponding fluid inlet cavity 224. The fluid then enters the fluid chamber 218 as the reciprocating member 222 continues to move longitudinally out of the fluid chamber 218 until the pressure difference between the fluid inside the fluid chamber 218 and the fluid at the fluid inlets 226 is low enough to permit the biasing member 230 to actuate the fluid inlet valve 228 to the closed flow position. As the reciprocating member 222 begins to move longitudinally back into the fluid chamber 218, as indicated by arrow 223, the pressure of the fluid inside the fluid chamber 218 begins to increase. The fluid pressure inside the fluid chamber 218 continues to increase as the reciprocating member 222 continues to move into the fluid chamber 218 until the pressure of the fluid inside the fluid chamber 218 is high enough to overcome the pressure of the fluid inside the fluid outlet cavity 234 and compress the biasing member 238, thus actuating the fluid outlet valve 236 to the open flow position and permitting the pressurized fluid to move into the fluid outlet cavity 234, the fluid outlets 235, and the corresponding fluid conduit 144.

The pump unit 150 may comprise one or more flow rate sensors 203 fluidly coupled with or along the fluid outlets 235 in a manner permitting monitoring of a fluid flow rate of the fluid flowing through the fluid outlets 235. Each flow sensor 203 may be or comprise a flow meter operable to measure the volumetric and/or mass flow rate of the fluid discharged from the pump unit 150, and to generate signals or information indicative of the flow rate of the fluid discharged from the pump unit 150. The pump unit 150 may further comprise a pressure sensor 205 disposed in association with the fluid section 210 in a manner permitting the sensing of fluid pressure at the fluid outlets 235. For example, the pressure sensor 205 may extend through one or more of the cover plates 242 or other portions of the corresponding pump housing 216 to monitor pressure within the fluid outlet cavity 234 and, thus, the fluid outlets 235 and the corresponding outlet conduits 144.

The fluid flow rate generated by the pump unit 150 may depend on the physical size of the reciprocating members 222 and fluid chambers 218, as well as the pump unit operating speed, which may be defined by the speed or rate at which the reciprocating members 222 cycle or move within the fluid chambers 218. The pumping speed, such as the speed or the rate at which the reciprocating members 222 move, may be related to the rotational speed of the power section 208 and/or the prime mover 204. Accordingly, the fluid flow rate generated by the pump unit 150 may be controlled by controlling the rotational speed of the power section 208 and/or the prime mover 204.

The prime mover 204 may be or comprise a gasoline, diesel, or other engine, a synchronous, asynchronous, or other electric motor (e.g., a synchronous permanent magnet motor), a hydraulic motor, or another prime mover operable to drive or otherwise rotate a drive shaft 252 of the power section 208. The drive shaft 252 may be enclosed and maintained in position by a power section housing 254. To prevent relative rotation between the power section housing 254 and the prime mover 204, the power section housing 254 and prime mover 204 may be fixedly coupled together or to a common base, such as a trailer of the mobile carrier 148.

The prime mover 204 may comprise a rotatable output shaft 256 operatively connected with the drive shaft 252 via a gear train or transmission 262, which may comprise at a spur gear 258 coupled with the drive shaft 252 and a corresponding pinion gear 260 coupled with a support shaft 261. The output shaft 256 and the support shaft 261 may be coupled, such as may facilitate transfer of torque from the prime mover 204 to the support shaft 261, the pinion gear 260, the spur gear 258, and the drive shaft 252. For clarity, FIGS. 2 and 3 show the transmission 262 comprising a single spur gear 258 engaging a single pinion gear 260, however, it is to be understood that the transmission 262 may comprise a plurality of corresponding sets of gears, such as may permit the transmission 262 to be shifted between different gear sets (i.e., combinations) to control the operating speed of the drive shaft 252 and the torque transferred to the drive shaft 252. Accordingly, the transmission 262 may be shifted between different gear sets ("gears") to vary the pumping speed and torque of the power section 208 and, thereby, vary the fluid flow rate and maximum fluid pressure generated by the fluid section 210.

The transmission 262 may also comprise a torque converter (not shown) operable to selectively connect ("lock-up") the prime mover 204 with the transmission 262 and permit slippage ("unlock") between the prime mover 204 and the transmission 262. The torque converter and the gears of the transmission 262 may be shifted manually by the wellsite operator 164 or remotely via a gear shifter, which may be incorporated as part of a pump unit controller 213. The gear shifter may receive control signals from the controller 161 and output a corresponding electrical or mechanical control signal to shift the gear of the transmission 262 and lock-up the transmission, such as to control the fluid flow rate and the operating pressure of the pump unit 150.

The drive shaft 252 may be implemented as a crankshaft comprising a plurality of axial journals 264 and offset journals 266. The axial journals 264 may extend along a central axis of rotation of the drive shaft 252, while the offset journals 266 may be offset from the central axis of rotation by a distance and spaced 120 degrees apart with respect to the axial journals 264. The drive shaft 252 may be supported in position within the power section 208 by the power section housing 254, wherein two of the axial journals 264 may extend through opposing openings in the power section housing 254.

The power section 208 and the fluid section 210 may be coupled or otherwise connected together. For example, the pump housing 216 may be fastened with the power section housing 254 by a plurality of threaded fasteners 282. The pump 202 may further comprise an access door 298, which may facilitate access to portions of the pump 202 located between the power section 208 and the fluid section 210, such as during assembly and/or maintenance of the pump 202.

To transform and transmit the rotational motion of the drive shaft 252 to a reciprocating linear motion of the reciprocating members 222, a plurality of crosshead mechanisms 285 may be utilized. For example, each crosshead mechanism 285 may comprise a connecting rod 286 pivotally coupled with a corresponding offset journal 266 at one end and with a pin 288 of a crosshead 290 at an opposing end. During pumping operations, walls and/or interior portions of the power section housing 254 may guide each crosshead 290, such as may reduce or eliminate lateral motion of each crosshead 290. Each crosshead mechanism 285 may further comprise a piston rod 292 coupling the crosshead 290 with the reciprocating member 222. The piston rod 292 may be coupled with the crosshead 290 via a threaded connection 294 and with the reciprocating member 222 via a flexible connection 296.

The pump unit 150 may further comprise one or more rotational position and speed ("rotary") sensors 211 operable to generate a signal or information indicative of rotational position, rotational speed, and/or operating frequency of the pump 202. For example, one or more of the rotary sensors 211 may be operable to convert angular position or motion of the drive shaft 252 or another rotating portion of the power section 208 to an electrical signal indicative of pumping speed of the pump unit 150. One or more of the rotary sensors 211 may be mounted in association with an external portion of the drive shaft 252 or other rotating member of the power section 208. One or more of the rotary sensors 211 may also or instead be mounted in association of the prime mover 204 to monitor the rotational position and/or rotational speed of the prime mover 204, which may be utilized to determine the pumping speed of the pump unit 150. Each rotary sensor 211 may be or comprise an encoder, a rotary potentiometer, a synchro, a resolver, and/or an RVDT (rotary variable differential transformer), among other examples.

The pump unit controller 213 may further include prime mover power and/or control components, such as a variable frequency drive (VFD) and/or an engine throttle control, which may be utilized to facilitate control of the prime mover 204. The VFD and/or throttle control may be connected with or otherwise in communication with the prime mover 204 via mechanical and/or electrical communication means (not shown). The pump unit controller 213 may include the VFD in implementations in which the prime mover 204 is or comprises an electric motor, and the pump unit controller 213 may include the engine throttle control in implementations in which the prime mover 204 is or comprises an engine. For example, the VFD may receive control signals from the controller 161 and output corresponding electrical power to control the speed and the torque output of the prime mover 204 and, thus, control the pumping speed and fluid flow rate of the pump unit 150, as well as the maximum pressure generated by the pump unit 150. The throttle control may receive control signals from the controller 161 and output a corresponding electrical or mechanical throttle control signal to control the speed of the prime mover 204 to control the pumping speed and, thus, the fluid flow rate generated by the pump unit 150. Although the pump unit controller 213 is shown located near or in association with the prime mover 204, the pump unit controller 213 may be located or disposed at a distance from the prime mover 204. For example, the pump unit controller 213 may be located within or form a portion of the control center 160.

A resistance temperature detector (RTD) or other temperature sensor 207 may be disposed in association with the prime mover 204, such as to generate a signal or information indicative of a temperature of the prime mover 204. For example, the temperature sensor 207 may monitor the temperature within a motor winding, an engine housing, or within another portion of the prime mover 204. The temperature sensor 207 may be in communication with the controller 161, which may shut down the prime mover 204 if the detected temperature level exceeds a predetermined temperature level.

A moisture sensor 209 may also be disposed in association with the prime mover 204, such as to generate a signal or information indicative of moisture present at or near the prime mover 204. The moisture sensor 209 may be in communication with the controller 161, which may shut down the prime mover 204 if excessive moisture is detected by the moisture sensor 209.

As described above, the controller 161 may be further operable to monitor and control various operational parameters of the pump units 150. The controller 161 may be in communication with the various sensors of the pump units 150, including the flow rate sensors 203, the pressure sensors 205, the temperature sensor 207, the moisture sensor 209, and the rotary sensor 211, to facilitate monitoring of the pump units 150. The controller 161 may be in communication with the transmission 262 via the gear shifter of the controller 213, such as to control the flow rate and pressure generated by the pump unit 150 to facilitate control of the pump unit 150. The controller 161 may also be in communication with the prime mover 204 via the VFD of the controller 213 if the prime mover 204 is an electric motor or via the throttle control of the controller 213 if the prime mover 204 is an engine, such as may permit the controller 161 to activate, deactivate, and control the flow rate generated by the pump unit 150.

Although FIGS. 2 and 3 show the pump unit 150 comprising a triplex reciprocating pump 202, which has three fluid chambers 218 and three reciprocating members 222, implementations within the scope of the present disclosure may include the pump 202 as or comprising a quintuplex reciprocating pump having five fluid chambers 218 and five reciprocating members 222, or a pump having other quantities of fluid chambers 218 and reciprocating members 222. It is further noted that the pump 202 described above and shown in FIGS. 2 and 3 is merely an example, and that other pumps, such as diaphragm pumps, gear pumps, external circumferential pumps, internal circumferential pumps, lobe pumps, and other positive displacement pumps, are also within the scope of the present disclosure.

Figure 4:
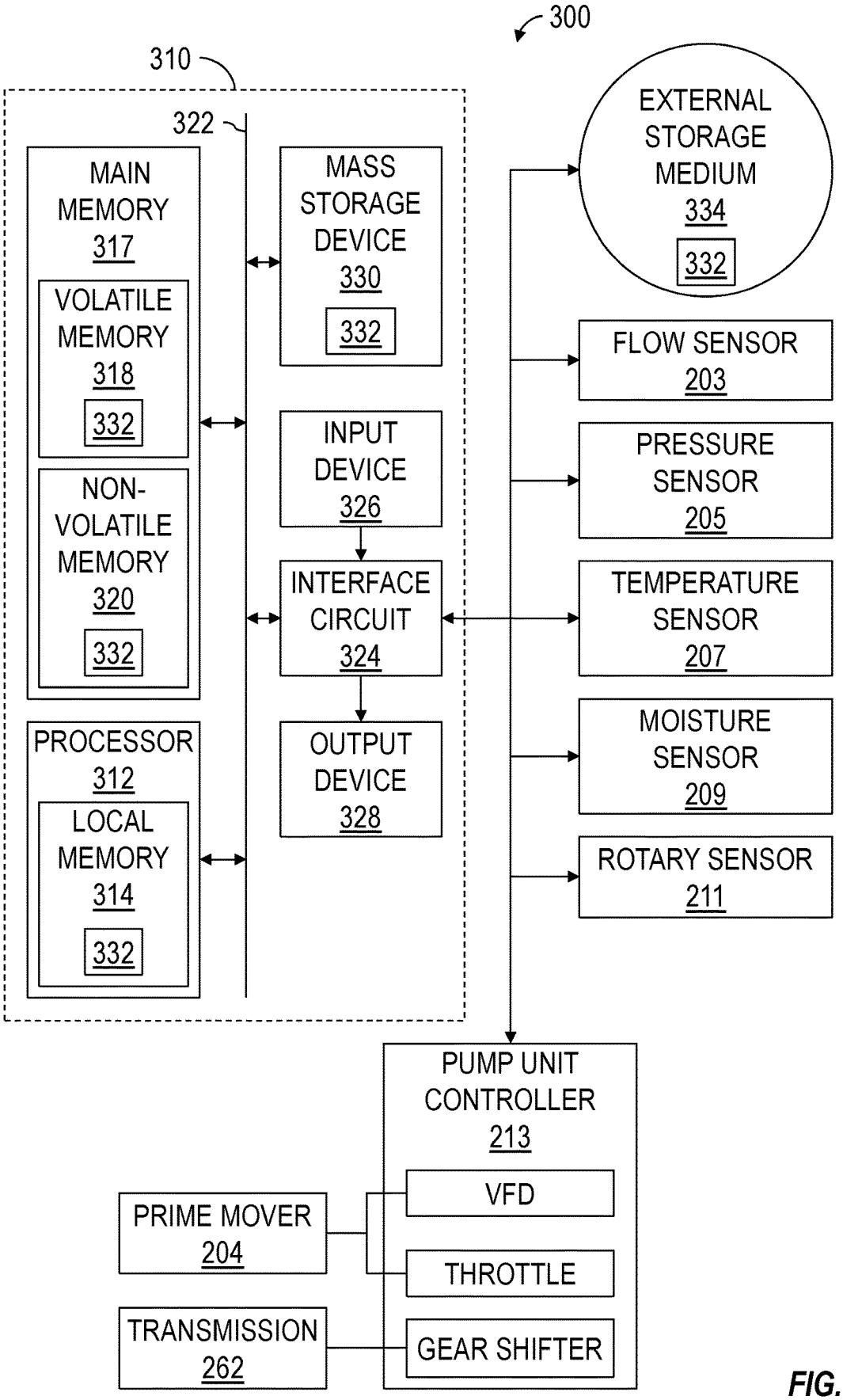
FIG. 4 is a schematic view of at least a portion of an example implementation of apparatus according to one or more aspects of the present disclosure.

The present disclosure further provides various implementations of systems and/or methods for controlling various portions of the wellsite system 100, including the pump units 150 described above. An implementation of such system may comprise a control system 300, such as may be operable to monitor and/or control operations of the pump units 150, including fluid flow rate generated by the pump units 150. FIG. 4 is a schematic view of a portion of an example implementation of the control system 300 according to one or more aspects of the present disclosure. The following description refers to FIGS. 1-4, collectively.

The control system 300 may include a controller 310 communicatively connected with each pump unit 150. For example, the controller 310 may be communicatively connected with each flow sensor 203, pressure sensor 205, temperature sensor 207, moisture sensor 209, rotary sensor 211, and prime mover 204 and transmission 262 via each pump unit controller 213. For clarity, these and other components in communication with the controller 310 will be collectively referred to hereinafter as "sensors and controlled components." The controller 310 may be operable to receive signals or information from the various sensors of the control system 300, the received signals or information being indicative of the various operational parameters of the pump units 150. The controller 310 may be further operable to process such operational parameters and communicate control signals to the prime movers 204 and the transmissions 262 to execute example machine-readable instructions to implement at least a portion of one or more of the example methods and/or processes described herein, and/or to implement at least a portion of one or more of the example systems described herein. The controller 310 may be or form a portion of the controller 161 described above.

The controller 310 may be or comprise, for example, one or more general-purpose or special-purpose processors, such as of personal computers, laptop computers, tablet computers, personal digital assistant (PDA) devices, smartphones, servers, interne appliances, and/or other types of computing devices. For clarity and ease of understanding, the example implementation of the controller 310 depicted in FIG. 4 includes just one processor 312, it being understood that multiple processors 312 may exist.

The processor 312 may be a general-purpose programmable processor, such as may comprise a local memory 314 and that may execute coded instructions 332 present in the local memory 314 and/or another memory device. The processor 312 may execute, among other things, machine-readable instructions or programs to implement the example methods and/or processes described herein. The programs stored in the local memory 314 may include program instructions or computer program code that, when executed by an associated processor, control the pump units 150 in performing the example methods and/or processes described herein. The processor 312 may be, comprise, or be implemented by one or a plurality of processors of various types suitable to the local application environment, and may include one or more general-purpose or special-purpose computers, microprocessors, digital signal processors (DSPs), field-programmable gate arrays (FPGAs), application-specific integrated circuits (ASICs), and processors based on a multi-core processor architecture, as non-limiting examples. Other processors from other families are also appropriate.

The processor 312 may be in communication with a main memory 317, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320. The controller 310 may be operable to store or record information entered by the wellsite operator 164 and/or information generated by the sensors and controlled components on the main memory 317.

The controller 310 may also comprise an interface circuit 324. The interface circuit 324 may be, comprise, or be implemented by various types of standard interfaces, such as an Ethernet interface, a universal serial bus (USB), a third-generation input/output (3GIO) interface, a wireless interface, and/or a cellular interface, among other examples. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the sensors and controlled components may be connected with the controller 310 via the interface circuit 324, such as may facilitate communication between the sensors and controlled components and the controller 310.

One or more input devices 326 may also be connected to the interface circuit 324. The input devices 326 may permit the wellsite operator 164 to enter the coded instructions 332, operational target set-points, and/or other data into the processor 312. The operational target set-points may include, but are not limited to, a pressure target set-point, a flow rate target set-point, a combined flow rate transition curve set-point, a pump operating or pumping speed target set-point, and a time or duration target set-point, among other examples. The coded instructions may also include a flow rate transition schedule for each pump unit 150 and a combined flow rate transition schedule for the pump units 150 allocated for a job. The coded instructions 332 and operational target set-points are described in more detail below. The input devices 326 may be, comprise, or be implemented by a keyboard, a mouse, a touchscreen, a track-pad, a trackball, an isopoint, and/or a voice recognition system, among other examples. One or more output devices 328 may also be connected to the interface circuit 324. The output devices 328 may be, comprise, or be implemented by display devices (e.g., a liquid crystal display (LCD) or cathode ray tube display (CRT)), printers, and/or speakers, among other examples. The controller 310 may also communicate with one or more mass storage devices 330 of the controller 310 and/or a removable storage medium 334, such as may be or include floppy disk drives, hard drive disks, compact disk (CD) drives, digital versatile disk (DVD) drives, and/or USB and/or other flash drives, among other examples.

The coded instructions 332, the operational target set-points, and/or other data may be stored in the mass storage device 330, the main memory 317, the local memory 314, and/or the removable storage medium 334. Thus, the controller 310 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a computer-readable medium or storage structure embodying computer program code (i.e., software or firmware) thereon for execution by the processor 312.

The coded instructions 332 may include program instructions or computer program code that, when executed by the processor 312, may cause the pump units 150 to perform methods, processes, and/or routines described herein. For example, the controller 310 may receive and process the operational target set-points entered by the operator 164 and the signals or information generated by the various sensors described herein indicative of the operational parameters of the pump units 150. Based on the coded instructions 332 and the received operational target set-points and operational parameters, the controller 310 may send signals or information to the prime movers 204 and the transmissions 262 to cause the pump units 150 and/or other portions of the wellsite system 100 to automatically perform and/or undergo one or more operations or routines within the scope of the present disclosure.

The present disclosure introduces methods by which a controller (such as the controller 161, 310 and/or others) may simultaneously and automatically operate a plurality of gear-shifting pump units (such as the pump units 150 and/or others). The methods may be implemented as algorithms (such as via the coded instructions 332 and/or others) executed by the controller to operate the pump units. For example, an algorithm according to one or more aspects of the present disclosure may be utilized to cause the controller to automatically operate the pump units pursuant to a predetermined operating schedule, including starting the pump units in a predetermined order and at predetermined flow rates. This and/or other algorithms within the scope of the present disclosure may be utilized to automatically populate the start order of the pump units based on the operating schedule, current job type, and/or pump unit physical rig-up location on a manifold (such as the manifold 136). Algorithms within the scope of the present disclosure may also be utilized to distribute flow rates to different pump units based on the start order, wellhead pressure, pump unit capability, and pump unit availability. Algorithms within the scope of the present disclosure may be implemented for operation as a master rate control (MRC) to group a plurality of pump units into logic pump groups, wherein each logic pump group may be treated as a single entity having a specified group flow rate set-point. The MCR may automatically allocate the specified group flow rate to individual pump units within the logic pump group. Algorithms within the scope of the present disclosure may also be utilized to automatically allocate flow rates to available pump units in a predetermined manner to, for example, optimize engine fuel efficiency and/or maximize overall pump life.

Figure 5:
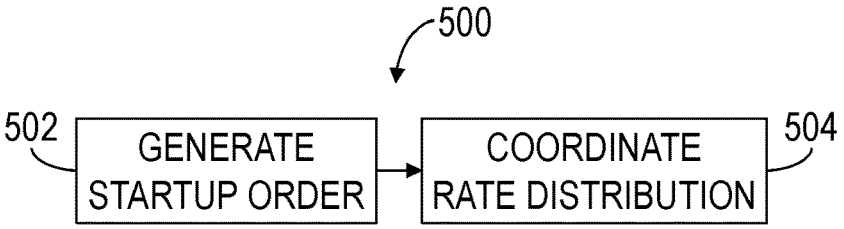
FIG. 5 is a flow-chart diagram of at least a portion of an example implementation of a method according to one or more aspects of the present disclosure.

FIG. 5 is a flow-chart diagram of at least a portion of an example implementation of a method 500 according to one or more aspects of the present disclosure. The method 500 may be performed utilizing or otherwise in conjunction with at least a portion of one or more implementations of one or more instances of the apparatus shown in one or more of FIGS. 1-4, and/or otherwise within the scope of the present disclosure. For example, the method 500 may be performed and/or caused, at least partially, by the controller 310 executing the coded instructions 332 according to one or more aspects of the present disclosure. Thus, the following description may also refer to apparatus shown in one or more of FIGS. 1-4. However, the method 500 may also be performed in conjunction with implementations of apparatus other than those depicted in FIGS. 1-4, and yet remain within the scope of the present disclosure.

The method 500 is depicted in FIG. 5 (and others) as being a method performed for the automated startup of pumps, including generating 502 a startup order and coordinating 504 rate distribution for the pumps. However, other implementations of the method 500 within the scope of the present disclosure may be for other operations of the pumps, such as a ramp-up operation, a shut-down operation, and/or others. That notwithstanding, for clarity and ease of understanding, the following description generally refers to a startup operation, it being understood that one or more aspects below and in the figures may be applicable or readily adaptable for pump operations other than startup operations.

Figure 6:
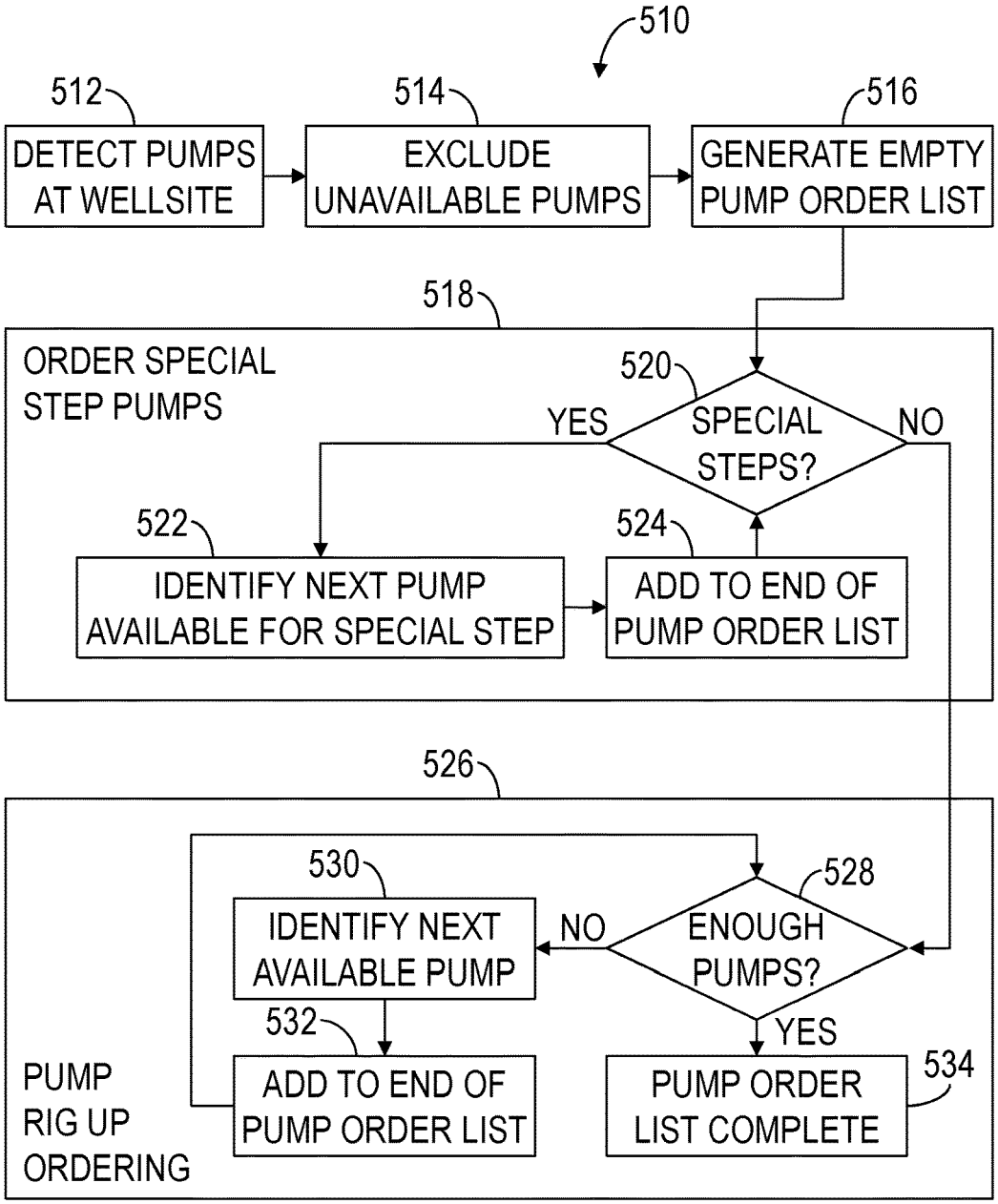
FIG. 6 is a flow-chart diagram of at least a portion of an example implementation of a method according to one or more aspects of the present disclosure.

Accurately generating 502 the startup order of the pumps can prevent adverse incidents, such as sanding off suction hoses, inadequate suction horsepower, and inadvertently changing fracturing fluid composition. Generating 502 the pump startup order may combine job executing steps and physical pump rig-up location. FIG. 6 is a flow-chart diagram of at least a portion of an example method 510 for the startup order generation 502 according to one or more aspects of the present disclosure.

The method 520 includes detecting 512 each of the pumps located at the wellsite, excluding 514 unavailable (offline, instant idled, etc.) pumps, and generating 516 an empty pump startup order list. Special step pumps are then ordered 518. For example, if it is determined 520 that a special step pump has yet to be scheduled for each special step that will utilize a pump, then the next pump available for the special step is identified 522 and added 524 to the end of the then-current pump startup order list. Special steps may include acidizing, water jet cutting, and other operations other than hydraulic fracturing. Identifying 522 the next pump available for a special step may entail selecting one of the available pumps that is more suited to the specific special step, although the identification 522 may instead (or also) simply select which of the available pumps is physically located closest to the wellhead 105, the source of fluid supplied to the pumping system 135 (e.g., the mixing unit 124), and/or another predetermined wellsite component. Each time a special step pump is added 524 to the pump startup order list, the pump is added at the end of the then-current list. The identifying 522 and adding 524 continue until it is determined 520 that there are no special steps remaining without an assigned pump.

Pump rig-up ordering 526 then commences. If it is determined 528 that there are not yet enough pumps scheduled for the fracturing operation (e.g., via comparison of the cumulative flow rates possible with the currently scheduled pumps to the intended flow rate of the pumping system), then the next available pump may be identified 530 and added 532 to the end of the then-current pump startup order list. Identifying 530 the next pump available for fracturing may entail selecting the remaining available pump that is physically located closest to the wellhead 105, the source of fluid supplied to the pumping system 135 (e.g., the mixing unit 124), and/or another predetermined wellsite component. Each time a frac pump is added 532 to the pump startup order list, the pump is added at the end of the then-current list. The identifying 530 and adding 532 continue until it is determined 528 that no additional pumps are to be added, at which time the pump startup order list may be considered as being complete 534. The method 510 may also include one or more additional steps for ordering, such as to sort the pumps on the list in order according to how close each pump is physically located to the wellhead 105, the source of fluid supplied to the pumping system 135 (e.g., the mixing unit 124), and/or another predetermined wellsite component.

Figure 7:
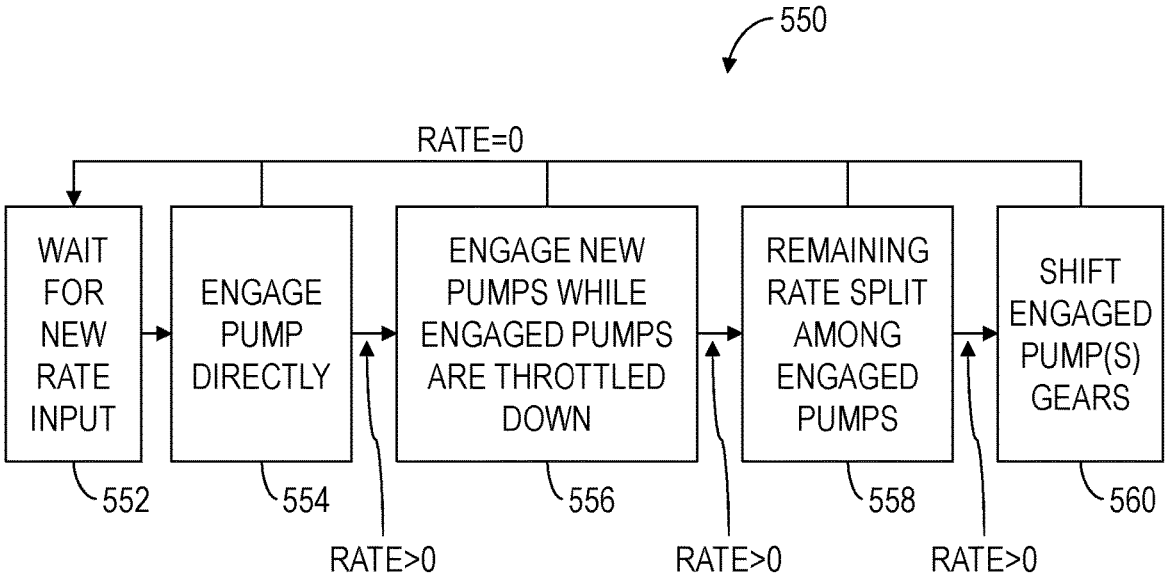
FIG. 7 is a flow-chart diagram of at least a portion of an example implementation of a method according to one or more aspects of the present disclosure.

Returning to FIG. 5, the coordination 504 of the pump rate distribution entails, after a controller and/or human operator inputs a target rate, engaging as many pumps as possible (in order) while reducing shifting of the pump gears. Engaging as many pumps as possible may reduce the chance of sanding off hoses (and perhaps other adverse events), and reducing gear shifting may reduce damage to pump transmissions and, thus, maintenance costs. FIG. 7 is a flow-chart diagram of at least a portion of an example method 550 for coordinating 504 the pump rate distribution according to one or more aspects of the present disclosure.

The method 550 includes waiting 552 for the new pump rate input by a controller or human operator. One or more pumps may then be directly engaged 554. One or more additional pumps may then be engaged 556 while the currently engaged pumps are throttled down. Then, the remaining rate not yet achieved by the engaged pumps may be split 558 among the engaged pumps. Gear shifting 560 may then occur, perhaps while also adding one or more additional pumps.

Figure 8:
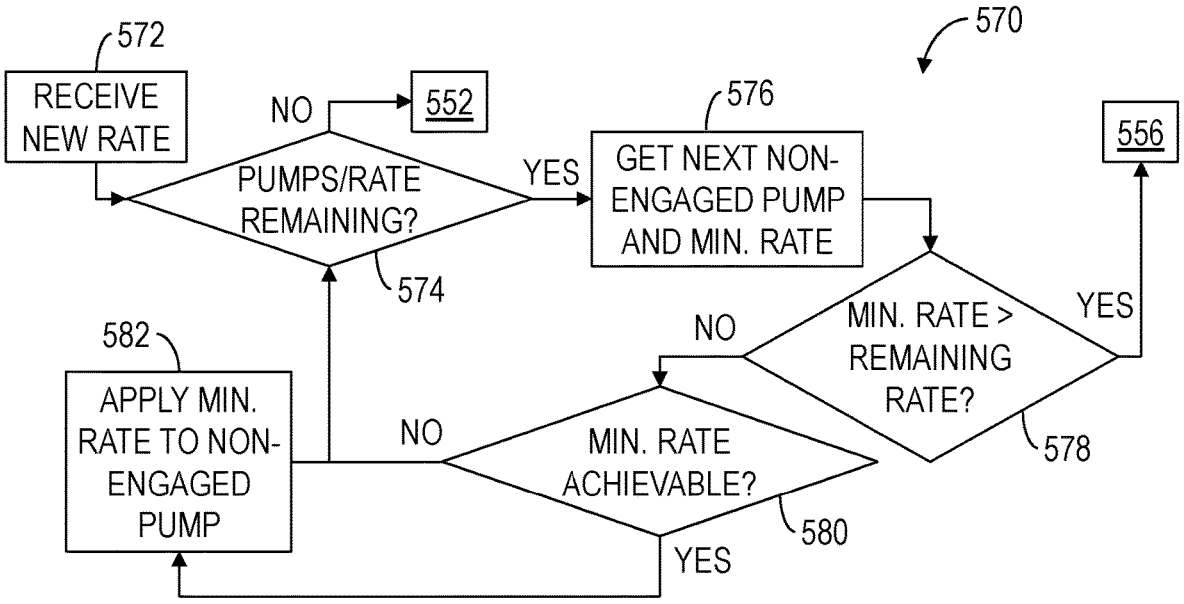
FIG. 8 is a flow-chart diagram of at least a portion of an example implementation of a method according to one or more aspects of the present disclosure.

FIG. 8 is a flow-chart diagram of at least a portion of an example method 570 for the direct engagement 554 of one or more pumps according to one or more aspects of the present disclosure. After the new rate has been received 572, there is a determination 574 of whether additional pumps are currently available, and/or whether the currently engaged pumps can collectively provide (or are providing) the received 572 rate. If no additional pumps are available, and/or the currently engaged pumps can provide (or are providing) the received 572 rate, the method 570 reverts to the waiting action 552 shown in FIG. 7. However, if the received 572 rate cannot be provided by the currently engaged pumps, and additional pumps are available, then the next non-engaged pump and its minimum rate are obtained 576 (e.g., via a lookup table and/or other controller-accessible means). If the minimum rate of the next non-engaged pump is determined 578 to be greater than the rate remaining to achieve the received 572 rate, then the method 570 reverts to the throttled down engagement 556 shown in FIG. 7. If the minimum rate of the next non-engaged pump is determined 578 to be less than or equal to the remaining rate to be achieved, but the minimum rate is determined 580 to not be achievable, then the method 570 returns to the pumps/rate remaining determination 574. If the minimum rate is determined 580 to be achievable, then the minimum rate is applied 582 to the non-engaged pump, and the method 570 then returns to the pumps/rate remaining determination 574.

Figure 9:
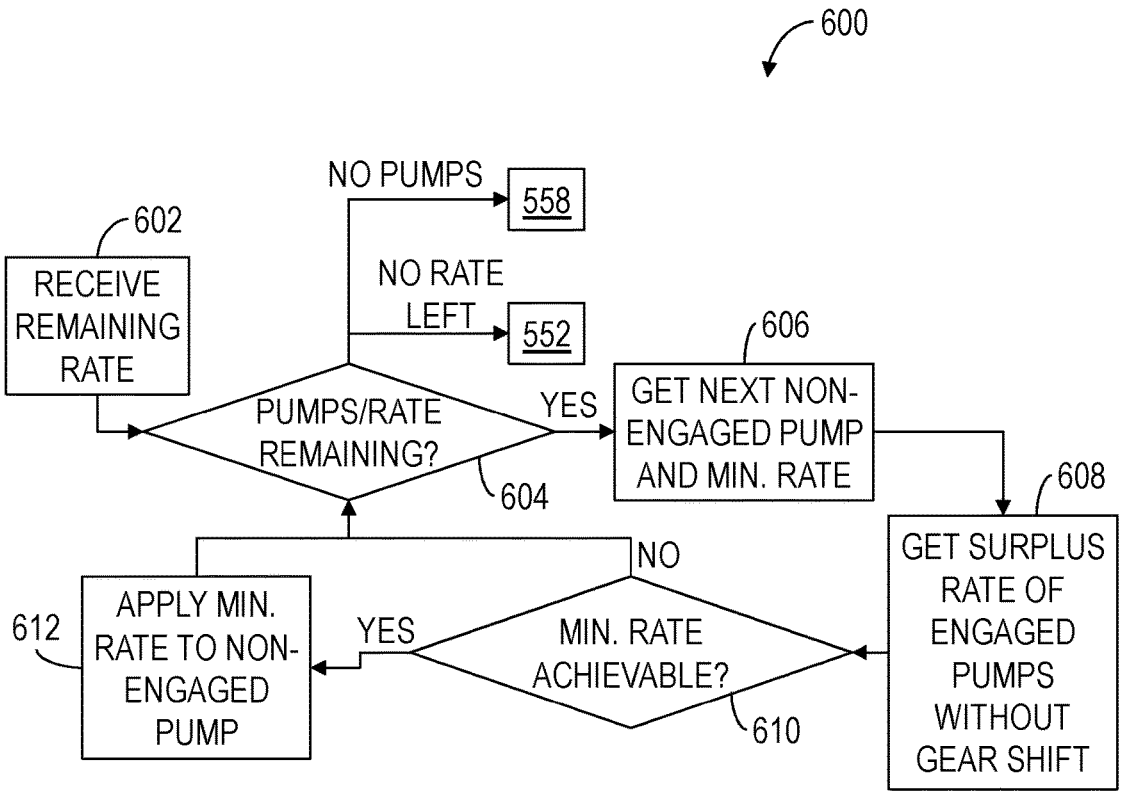
FIG. 9 is a flow-chart diagram of at least a portion of an example implementation of a method according to one or more aspects of the present disclosure.

FIG. 9 is a flow-chart diagram of at least a portion of an example method 600 for the engagement 556 of one or more new pumps while the currently engaged pumps are throttled down, according to one or more aspects of the present disclosure. After the remaining rate has been received 602, there is a determination 604 of whether additional pumps are currently available, and/or whether the currently engaged pumps can collectively provide (or are providing) the received 602 rate. If no additional pumps are available, then the method 600 reverts to the rate splitting 558 shown in FIG. 7, and if the currently engaged pumps can provide (or are providing) the received 602 rate, the method 600 reverts to the waiting action 552 shown in FIG. 7. However, if the received 602 rate cannot be provided by the currently engaged pumps at the current throttling (likely to be less than maximum, and perhaps minimum), and additional pumps are available, then the next non-engaged pump and its minimum rate are obtained 606 (e.g., via a lookup table and/or other controller-accessible means). The surplus rates available from each currently engaged pump without shifting gears (i.e., by throttling up) are then obtained 608. If the minimum rate is not achievable, as determined 610 based on the remaining rate, the minimum rate of the next non-engaged pump, and the cumulative surplus available from the currently engaged pumps, then the method 600 returns to the pumps/rate remaining determination 604. If the minimum rate is determined 610 to be achievable, then the minimum rate is applied 612 to the non-engaged pump, and the method 600 then returns to the pumps/rate remaining determination 604.

Figure 10:
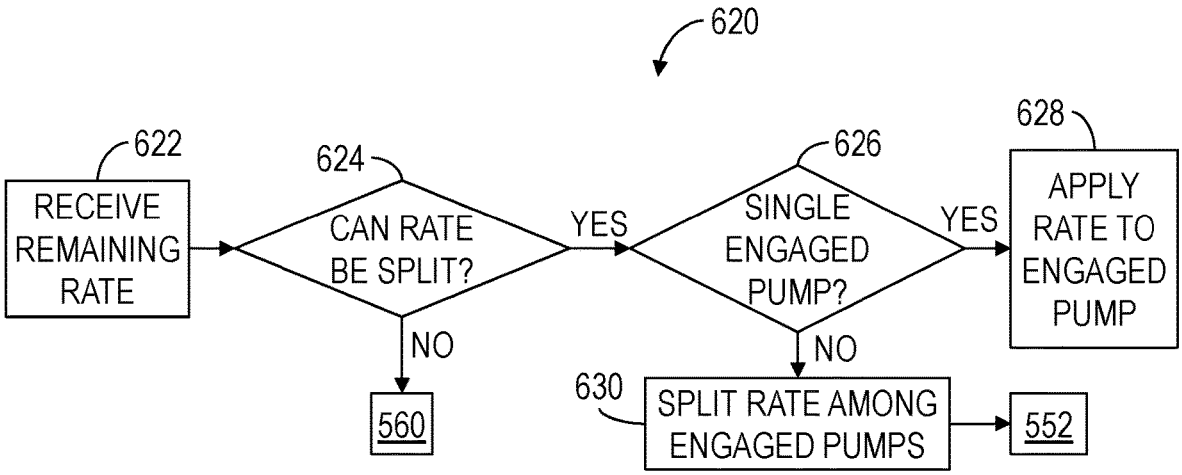
FIG. 10 is a flow-chart diagram of at least a portion of an example implementation of a method according to one or more aspects of the present disclosure.

The remaining rate not achieved by the currently engaged pumps may be split 558 among the currently engaged pumps via the example method 620 depicted by the flow-chart diagram shown in FIG. 10. After the remaining rate has been received 622, there is a determination 624 of whether the remaining rate can be split. If the remaining rate cannot be split, the method reverts to the gear shifting 560 shown in FIG. 7. If the remaining rate can be split, there is a determination 626 of whether one or more pumps are currently engaged. If just one pump is engaged, the remaining rate is applied 628 to that pump, perhaps with a gear shift to achieve the remaining rate. If it is determined 626 that more than one pump is engaged, the remaining rate is split 630 among the engaged pumps without gear shifting, and the waiting 552 then resumes.

Figure 11:
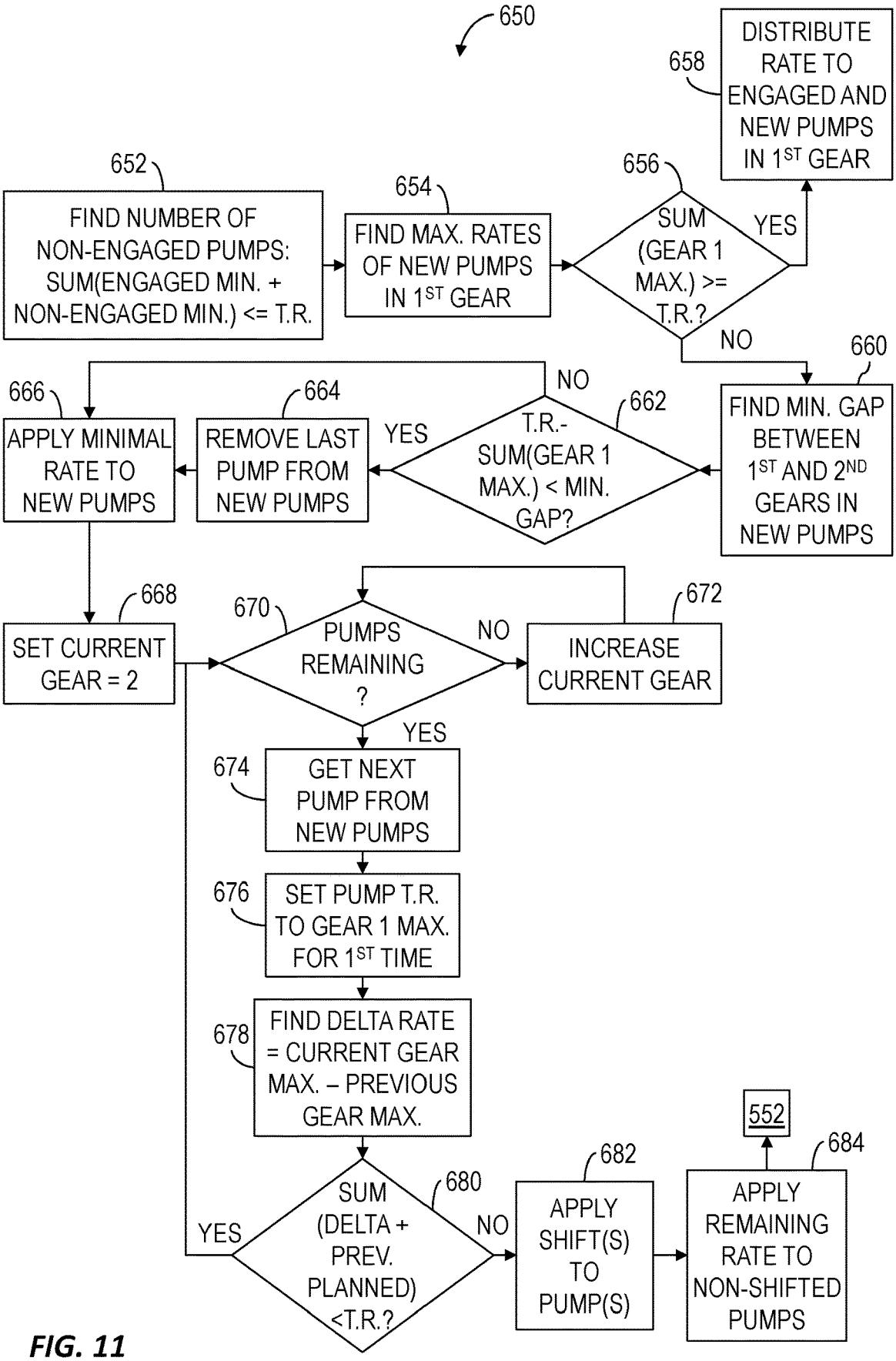
FIG. 11 is a flow-chart diagram of at least a portion of an example implementation of a method according to one or more aspects of the present disclosure.

FIG. 11 is a flow-chart diagram of at least a portion of an example method 650 for shifting 560 gears of the engaged pumps to achieve the remaining rate not achieved by the direct engagement 554, the throttled down engagement 556, and the rate splitting 558 described above. The method 650 includes finding 652 the maximum number of non-engaged pumps by which the sum of their minimum rates and the minimum rates of the engaged pumps, collectively, is less than or equal to the total requested rate. The maximum rates of the new pumps in first gear are then obtained 654. If it is determined 656 that the sum of the maximum rates of the new pumps in first gear is greater than or equal to the total rate, then the remaining rate is distributed 658 among the currently engaged pumps and the new pumps, each in first gear. If the sum of the maximum rates of the new pumps in first gear is determined 656 to be less than the total rate, then the minimum rate gaps of the new pumps between first and second gear are determined 660. If the difference between the total rate and the obtained 654 sum of the maximum rates of the new pumps in first gear is determined 662 to be less than the determined 660 minimum rate gaps, then the last of the new pumps is removed 664, and the minimum rates of the remaining new pumps are applied 666 to the new pumps. If such difference is determined 662 to not be less than the determined 660 minimum rate gaps, then the minimum rates of the new pumps are applied 666 to the new pumps without removing 664 the last new pump. Each then engaged pump is then set 668 to second gear.

If it is then determined 670 that there are no pumps remaining, then the current gear is increased 672. Otherwise, the next available pump is obtained 674, the pump total rate is set 676 to the first gear maximum for the first time, and then a delta rate is obtained 678 as the difference between the current gear maximum rate and the previous gear maximum rate. If the sum of the delta rate and the previously planned rate is determined 680 to be less than the total rate, then the method returns to the remaining pump determination 670. Otherwise, one or more gear shifts are applied 682 to one or more pumps. Remaining rate is then applied 684 to the non-shifted pumps, and the waiting 552 then resumes.

The present disclosure also introduces aspects related to a Master Rate Control (MRC), a Group Rate Control (GRC), and a Total Rate Control (TRC), which may be utilized in comprehensively orchestrating entire pump fleets in order to achieve intended pumping system rates. The MRC permits multiple pumps to be grouped into one or more logic groups of pumps. For the user (whether a controller or a human operator), each pump group is treated as a single entity having a single rate set-point. Implementations utilizing the MRC may automatically allocate the pump rate of the group to the individual pumps within the group.

A pump group may be a subset of the collective pumps available at the wellsite, and each pump group may be run as a single MRC. More than one group may be defined (e.g., for a split stream operation, or SSO), with each group running its own MRC. Grouped pumps may be operated (e.g., via a human-machine interface (HMI) and/or other controller) as one "big pump" with one master rate set-point at the controlling interface.

Grouping may permit a small number of pumps to be grouped together to run an MRC, with each remaining pump at the wellsite being operated manually and/or via individual Automated Rate Control (ARC). In other implementations, MRC techniques may be utilized for automating all pumps at the wellsite, except perhaps for the special pumps (acid pump, pumps with issues, etc.). The grouping(s) at a wellsite may also be dynamic, such as in implementations in which all pumps are initially in one group with a single MRC, but one or more pumps may be removed from the group to deal with special operations.

Pump grouping may also provide fundamental support during SSO. For example, SSO may utilize two (or more) separate rate controls, such as for clean and dirty sides of the operation, and each separate rate control may be realized by a corresponding group with MRC.

Pump grouping may also provide flexibility to permit some pumps to be controlled separately. For example, one or more pumps may be separately controlled for acid pumping, wireline pump-down, and/or other special operations. One or more pumps may also be separately controlled if the pump(s) is degraded, such as to limit the maximum gear to be used with such pump(s).

MRC for each group may use their own aggregated rate as a feedback. Thus, there may be reduced or no interference between the groups, or with other pumps being operated manual and/or via ARC.

In MRC, the master rate set-point is optimally allocated to each available individual pump. Different strategies for doing so may be followed at different stages of operation. The following description focuses on the rate planning/distribution after each of the available pumps are engaged (each pump is pumping fluid).

In addition to meeting the specified master rate set-point, MRC also aims to allocate the rate to the available pumps in a manner that optimizes engine fuel efficiency and maximizes overall pump life. For example, pump fuel consumption and overall pump life may be maximized with engine throttle set to about 1,650 rpm and engine load between about 60% and about 80%. The present disclosure introduces a method accounting for the information of the designed final treatment rate (the pumping rate that will last for the major part of the fracturing treatment stage) during the intermediate rate transitions.

For example, the rate distribution may be optimized according to the designed final rate. That is, it is possible to optimally plan the final rate distribution before the treatment begins, so that rates are allocated to the pumps according to the planned rates. The principles of throttle being as close as possible to 1,650 rpm and engine load being between 60% and 80% are followed to optimize the fuel efficiency and overall pump life.

To optimize rate distribution according to the designed final rate, a user specifies the treating pressure and, for each pump, a selection of the maximum gear that tolerates the treating pressure with a predetermined factor. For example, if the factor is 1.15, and the given treating pressure is 9,000 psi, then the factored treating pressure will be 10,350 psi.

Figure 12:
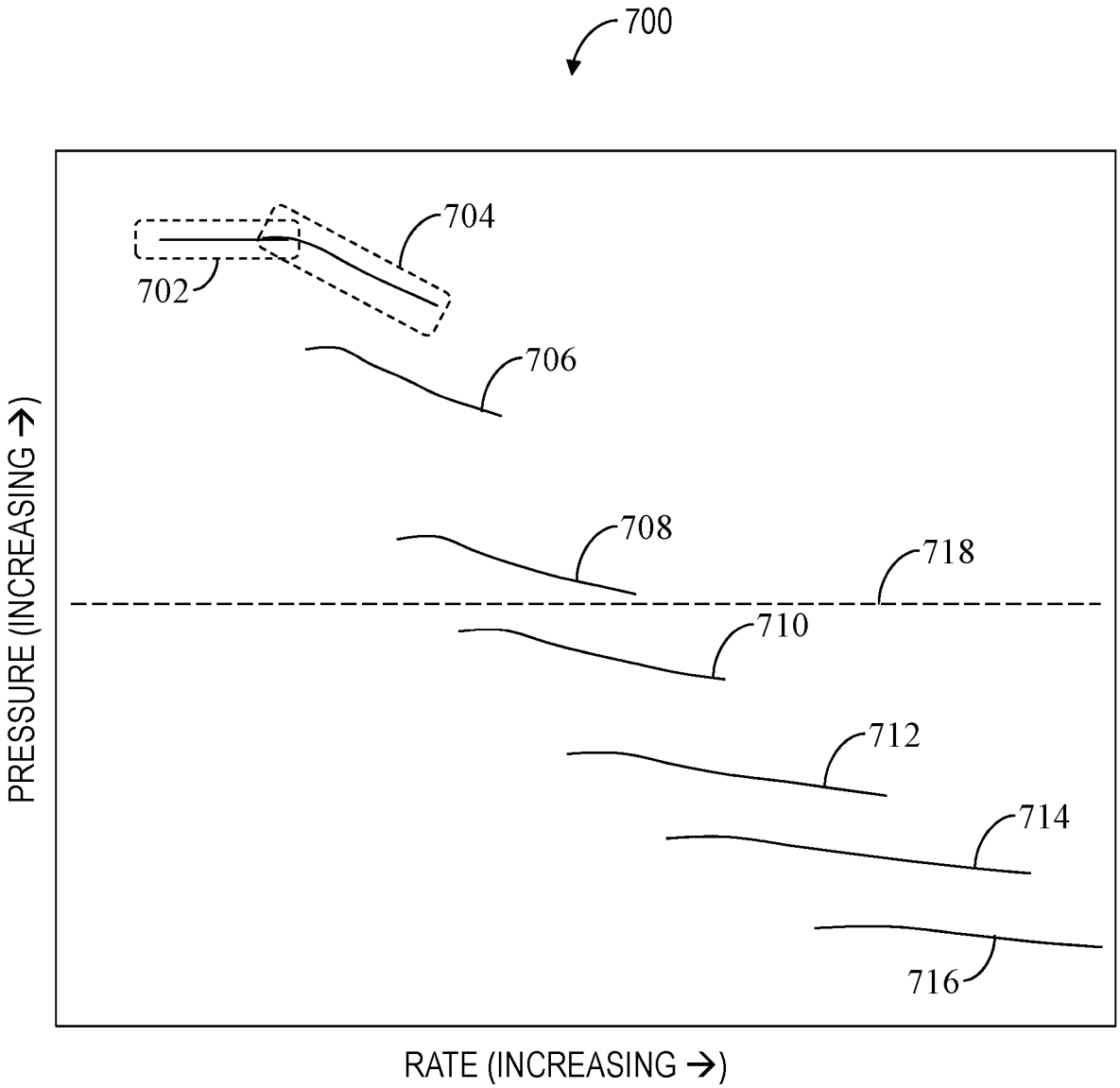
FIG. 12 is a graph depicting one or more aspects of the present disclosure.

An example is depicted in the graph 700 shown in FIG. 12, in which pressure versus rate is depicted for first gear 702, second gear 704, third gear 706, fourth gear 708, fifth gear 710, sixth gear 712, seventh gear 714, and eighth gear 716. The factored treating pressure (e.g., 10,350 psi) is depicted by dashed line 718, indicating that the maximum gear is fourth gear 708. With throttle being at 1,650 rpm, this example pump offers the optimal rate of 7.43 bpm at fourth gear.

With the optimal rates for each individual pump and total rate, the final treatment rate according to the schedule is allocated proportionally. After this linear scaling down, however, the pumps are likely to no longer be running at their optimal throttle. However, an iterative approach can be applied to adjust the rate distribution in order to move the pumps back as close as possible to the optimal RPM operation point.

For example, the scheduled final rate may be proportionally allocated to all pumps according to Equation (1) set forth below.

$$R_{i_final} = R_{i_opt} \frac{R_{t_final}}{R_{t_opt}} \tag{1}$$

where: $R_{t_final}$ is the final total rate according to the treatment schedule;

$R_{i_opt}$ is the optimal rate for individual pumps (e.g., throttle at 1650 rpm and highest gear to tolerate 1.15*treating pressure);

$R_{i_final}$ is the distributed rate for individual pumps in order to meet the final rate in the schedule; and $R_{t_opt}=\Sigma_i R_{i_opt}$ is the total optimal rate by all available pumps.

The first pump throttle is then adjusted to the optimal value (e.g., 1,650 rpm), so that $R_{1_final} \rightarrow R'_{1_final}$. The final rate is then adjusted for the rest of the pumps, so that $R'_{t_final}=R_{t_final}\ R'_{1_final}$. This method is then repeated with the adjusted final rate for the rest of the pumps. During the startup process, after each of the pumps are engaged, the planned rates for each individual pump is applied as the user and/or controller slowly increases the rate set-point.

However, other methods may be utilized for optimizing the rate allocation. For example, the rate distribution may be optimally allocated to the pumps one-by-one. That is, instead of proportionally distributing the master rate set-point to each of the available pumps, the optimization principles described above may be applied and the rate may be optimally allocated to the pumps one-by-one as new rate set-point is received (after each of the pumps, collectively, are engaged).

For example, for given treating pressure, the optimal rate $R_{i_opt}$ may be estimated for each pump according to the optimal gear (e.g., the highest gear that can tolerate the treating pressure after factoring as described above) and optimal throttle (e.g., 1,650 rpm). After a new rate set-point is received, the extra rate may be distributed to the pumps in the order of a predefined sequence so that the pumps are operating at their optimal rate $R_{i_opt}$. This may involve just a subset of the whole pump group. The last pump involved in the rate allocation may not operate at its optimal rate, but the rest of the pumps may remain at their minimum rates.

This concept of rate allocation is flexible. For example, it permits a user and/or controller to group the subset of available pumps and run the pump group as one MRC, because it can consider just the current rate set point. As a result, a subset of the pumps may be running at their minimum rates, but perhaps not in optimal gear.

There may also be a one-time rate optimization for the final, steady-state pumping stage. That is, when moving from one rate to another, the current pump state may also be considered so that the number of gear shifts is minimized. Thus, the new rate can be accommodated by just adjusting the pump engine throttle without shifting gears. Accordingly, after some intermediate rate changes (e.g., at the beginning stage of a fracturing job) by the operator and/or controller, the rate distribution among the pumps may not be optimal in terms of fuel consumption and engine load.

After the formation is fractured by pumping, the pumping may be maintained at the same rate for an extended period of the time. A one-time optimization that prioritizes engine throttle (e.g., as close as possible to 1,650 rpm) and engine load being in a predetermined range (e.g., 60-80%) can be achieved by selecting the appropriate gear. This one-time optimization can be triggered by a rate set-point reaching the final rate. The one-time optimization may also be triggered by user selection (e.g., depressing or clicking a button). The one-time optimization may also be performed automatically in response to a predetermined event, such as the detection of the same rate exceeding a predetermined period of time.

In view of the entirety of the present disclosure, including the figures and the claims, a person having ordinary skill in the art will readily recognize that the present disclosure introduces a method comprising: generating a startup order of pumps of a pumping system for performing a subterranean formation fracturing operation; and coordinating distribution of flow rates to the pumps.

Generating the startup order may comprise: (A) determining that a pump order list does not include enough pumps for pumping fracturing fluid for the fracturing operation; and then (B) iteratively, until the pump order list includes enough pumps for pumping fracturing fluid for the fracturing operation: (i) identifying a next one of the pumps that is not on the pump order list and that is available for pumping fracturing fluid for the fracturing operation; and (ii) adding the identified next available fracturing fluid pump to the end of the then-current pump order list. Determining that the pump order list does not include enough pumps for pumping fracturing fluid for the fracturing operation may comprise comparing cumulative flow rates possible with the fracturing fluid pumps on the pump order list to a target flow rate of the pumping system for performing the fracturing operation. Identifying the next available fracturing fluid pump may comprises identifying, from among the pumps that are not on the pump order list and that are available for pumping fracturing fluid, which fracturing fluid pump is physically located closest to a predetermined component of a wellsite system comprising the pumping system. Generating the startup order may further comprise, before determining that the pump order list does not include enough fracturing fluid pumps: (A) determining that the pump order list does not include enough pumps for pumping fluid other than fracturing fluid for at least one non-fracturing operation associated with the fracturing operation; and then (B) iteratively, until the pump order list includes enough pumps for pumping fluid other than fracturing fluid for the at least one non-fracturing operation: (i) identifying a next one of the pumps that is not on the pump order list and that is available for pumping fluid other than fracturing fluid for the at least one non-fracturing operation; and (ii) adding the identified next available non-fracturing fluid pump to the end of the then-current pump order list. Identifying the next available non-fracturing fluid pump may comprise identifying, from among the pumps that are not on the pump order list and that are available for pumping fluid other than fracturing fluid, which pump is most suited to the corresponding non-fracturing operation.

The pumps may comprise zero or more first pumps not currently engaged and thus not contributing to a current pumping rate of the pumping system, and zero or more second pumps currently engaged and thus collectively providing the current pumping rate of the pumping system, and coordinating the distribution of flow rates may comprise: (A) determining that either: (i) the second pumps are not collectively able to provide a target pumping rate of the pumping system that is greater than the current pumping rate of the pumping system; or (ii) the first pumps are available for, collectively with the second pumps, contributing to the target pumping rate of the pumping system; and (B) iteratively, until engaged ones of the first and second pumps are collectively able to provide the target pumping rate of the pumping system and no first pumps remain available: (i) determining that a minimum rate of a next available one of the first pumps is not greater than a difference between the current and target pumping rates of the pumping system; and (ii) engaging the next available first pump at its minimum rate.

The pumps may comprise zero or more first pumps not currently engaged and thus not contributing to a current pumping rate of the pumping system, and zero or more second pumps currently engaged and thus collectively providing the current pumping rate of the pumping system, and coordinating the distribution of flow rates may comprise: (A) determining that either: (i) the second pumps are not collectively able to provide a target pumping rate of the pumping system that is greater than the current pumping rate of the pumping system; or (ii) the first pumps are available for, collectively with the second pumps, contributing to the target pumping rate of the pumping system; and (B) iteratively, until engaged ones of the first and second pumps are collectively able to provide the target pumping rate of the pumping system and no first pumps remain available: (i) determining that a minimum rate of a next available one of the first pumps is greater than a difference between the current and target pumping rates of the pumping system; (ii) determining that the minimum rate of the next available first pump is achievable based on that minimum rate, the difference between the current and target pumping rates of the pumping system, and surplus rates of the engaged ones of the first and second pumps without shifting gearing associated with the engaged ones of the first and second pumps; and (iii) engaging the next available first pump at its minimum rate.

Coordinating the distribution of flow rates may comprise: determining that currently engaged ones of the pumps are collectively able to provide a target pumping rate of the pumping system that is greater than the current pumping rate of the pumping system; determining that a difference between the current and target pumping rates of the pumping system can be split among the currently engaged ones of the pumps; and increasing the current individual rates of the currently engaged ones of the pumps by corresponding amounts resulting from splitting the difference between the current and target pumping rates of the pumping system among the currently engaged ones of the pumps.

Coordinating the distribution of flow rates may comprise: (A) determining that currently engaged ones of the pumps are collectively able to provide a target pumping rate of the pumping system that is greater than the current pumping rate of the pumping system, and determining that a difference between the current and target pumping rates of the pumping system cannot be split among the currently engaged ones of the pumps, and determining the maximum number of non-engaged ones of the pumps by which the sum of the individual minimum rates of the non-engaged pumps and the individual minimum rates of the engaged pumps, collectively, is not greater than the target pumping rate of the pumping system; then (B) either: (i) determining that the sum of the maximum rates of the non-engaged pumps associated with their lowest gear is not less than the target pumping rate of the pumping system, and consequently: (a) engaging the non-engaged pumps as new pumps; and (b) adjusting the rates of all engaged pumps to distribute the target pumping rate of the pumping system substantially evenly among all engaged pumps with each in the lowest gear; or (ii) determining that the sum of the maximum rates of the non-engaged pumps associated with their lowest gear is less than the target pumping rate of the pumping system, and consequently: (a) determining minimum rate gaps of the non-engaged pumps associated with their two lowest gears; and (b) either: (1) determining that the difference between the target pumping rate of the pumping system and the sum of the maximum rates of the non-engaged pumps associated with their lowest gear is not less than the determined minimum rate gaps, and consequently: engaging the non-engaged pumps as new pumps at their minimum rates; and then shifting transmissions of all engaged pumps to their second lowest gears; or (2) determining that the difference between the target pumping rate of the pumping system and the sum of the maximum rates of the non-engaged pumps associated with their lowest gear is less than the determined minimum rate gaps, and consequently: engaging all but one of the non-engaged pumps as new pumps at their minimum rates; and then shifting transmissions of all engaged pumps to their second lowest gears; then (C) upshift the transmission of each new pump one at a time and one gear at a time, such that each new pump transmission is no more than one gear different than the other new pumps, until the target pumping rate of the pumping system can be achieved with all of the engaged pumps at their then-minimum rates; and then (D) increasing the rates of the lower-geared one or more of the new pumps until the target pumping rate of the pumping system is achieve.

One of the pumps may be a group of pumps operated at substantially the same rate and the same gearing.

The present disclosure also introduces a method comprising: generating an operating order of pumps of a pumping system for performing a pumping operation; and coordinating distribution of flow rates to the pumps for performing the pumping operation.

Generating the operating order may comprise: (A) determining that a pump order list does not include enough pumps for pumping fluid for the pumping operation; and then (B) iteratively, until the pump order list includes enough pumps for pumping fluid for the pumping operation: (i) identifying a next one of the pumps that is not on the pump order list and that is available for pumping fluid for the pumping operation; and (ii) adding the identified next available pump to the end of the then-current pump order list. Determining that the pump order list does not include enough pumps for pumping fluid for the pumping operation may comprise comparing cumulative flow rates possible with the pumps on the pump order list to a target flow rate of the pumping system for performing the pumping operation. Identifying the next available pump may comprise identifying, from among the pumps that are not on the pump order list and that are available for pumping fluid, which pump is physically located closest to a predetermined component of a wellsite system comprising the pumping system. The pumping operation may be a first pumping operation, the fluid may be a first fluid, and generating the operating order may further comprise, before determining that the pump order list does not include enough pumps: (A) determining that the pump order list does not include enough pumps for pumping a second fluid for at least one second pumping operation associated with the first pumping operation; and then (B) iteratively, until the pump order list includes enough pumps for pumping the second fluid for the at least one second pumping operation: (i) identifying a next one of the pumps that is not on the pump order list and that is available for pumping the second fluid for the at least one second pumping operation; and (ii) adding the identified next available second-fluid pump to the end of the then-current pump order list.

The pumps may comprise zero or more first pumps not currently engaged and thus not contributing to a current pumping rate of the pumping system, and zero or more second pumps currently engaged and thus collectively providing the current pumping rate of the pumping system, and coordinating the distribution of flow rates may comprise: (A) determining that either: (i) the second pumps are not collectively able to provide a target pumping rate of the pumping system that is greater than the current pumping rate of the pumping system; or (ii) the first pumps are available for, collectively with the second pumps, contributing to the target pumping rate of the pumping system; and (B) iteratively, until engaged ones of the first and second pumps are collectively able to provide the target pumping rate of the pumping system and no first pumps remain available: (i) determining that a minimum rate of a next available one of the first pumps is not greater than a difference between the current and target pumping rates of the pumping system; and (ii) engaging the next available first pump at its minimum rate.

The pumps may comprise zero or more first pumps not currently engaged and thus not contributing to a current pumping rate of the pumping system, and zero or more second pumps currently engaged and thus collectively providing the current pumping rate of the pumping system, and coordinating the distribution of flow rates may comprise: (A) determining that either: (i) the second pumps are not collectively able to provide a target pumping rate of the pumping system that is greater than the current pumping rate of the pumping system; or (ii) the first pumps are available for, collectively with the second pumps, contributing to the target pumping rate of the pumping system; and (B) iteratively, until engaged ones of the first and second pumps are collectively able to provide the target pumping rate of the pumping system and no first pumps remain available: (i) determining that a minimum rate of a next available one of the first pumps is greater than a difference between the current and target pumping rates of the pumping system; (ii) determining that the minimum rate of the next available first pump is achievable based on that minimum rate, the difference between the current and target pumping rates of the pumping system, and surplus rates of the engaged ones of the first and second pumps without shifting gearing associated with the engaged ones of the first and second pumps; and (iii) engaging the next available first pump at its minimum rate.

Coordinating the distribution of flow rates may comprise: determining that currently engaged ones of the pumps are collectively able to provide a target pumping rate of the pumping system that is greater than the current pumping rate of the pumping system; determining that a difference between the current and target pumping rates of the pumping system can be split among the currently engaged ones of the pumps; and increasing the current individual rates of the currently engaged ones of the pumps by corresponding amounts resulting from splitting the difference between the current and target pumping rates of the pumping system among the currently engaged ones of the pumps.

At least one of the pumps may be a group of pumps operated at substantially the same rate and the same gearing.

The present disclosure also introduces an apparatus comprising a coordinating controller capable of communicatively connecting to pump unit controllers of two or more pump units, wherein: (A) each pump unit controller is in communication with at least one of a variable frequency drive, an engine throttle, a gear shifter, a prime mover, or a transmission of the corresponding pump unit; (B) the coordinating controller comprises: a programmable processor having a memory device; and an interface circuit connected to an input device; (C) the programmable processor is operable to process coded instructions from the input device and communicate the coded instructions to at least one of the pump unit controllers; and (D) the at least one of the variable frequency drive, the engine throttle, the gear shifter, the prime mover, and/or the transmission of at least one of the pump units is responsive to the coded instructions.

The coded instructions may pertain to generating an operating order of the pump units for performing a pumping operation, and/or coordinating distribution of flow rates to the pump units for performing the pumping operation, as described above.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method (500) comprising:

generating (502) a startup order of pumps (150) of a pumping system (135) for performing a subterranean formation (106) fracturing operation;

determining (528) that a pump order list does not include enough pumps for pumping fracturing fluid for the fracturing operation; and then iteratively, until the pump order list includes enough pumps for pumping fracturing fluid for the fracturing operation:

identifying (530) a next one of the pumps that is not on the pump order list and that is available for pumping fracturing fluid for the fracturing operation; and adding (532) the identified next available fracturing fluid pump to the end of the then-current pump order list; and coordinating (504) distribution of flow rates to the pumps.

2. The method of claim 1 wherein determining that the pump order list does not include enough pumps for pumping fracturing fluid for the fracturing operation comprises comparing cumulative flow rates possible with the fracturing fluid pumps on the pump order list to a target flow rate of the pumping system for performing the fracturing operation.

3. The method of claim 1 wherein identifying the next available fracturing fluid pump comprises identifying, from among the pumps that are not on the pump order list and that are available for pumping fracturing fluid, which fracturing fluid pump is physically located closest to a predetermined component of a wellsite system (100) comprising the pumping system.

4. The method of claim 1 wherein generating the startup order further comprises, before determining that the pump order list does not include enough fracturing fluid pumps:

determining (520) that the pump order list does not include enough pumps for pumping fluid other than fracturing fluid for at least one non-fracturing operation associated with the fracturing operation; and then iteratively, until the pump order list includes enough pumps for pumping fluid other than fracturing fluid for the at least one non-fracturing operation:

identifying (522) a next one of the pumps that is not on the pump order list and that is available for pumping fluid other than fracturing fluid for the at least one non-fracturing operation; and adding (524) the identified next available non-fracturing fluid pump to the end of the then-current pump order list.

5. The method of claim 4 wherein identifying the next available non-fracturing fluid pump comprises identifying, from among the pumps that are not on the pump order list and that are available for pumping fluid other than fracturing fluid, which pump is most suited to the corresponding non-fracturing operation.

6. The method of claim 1 wherein the pumps comprise zero or more first pumps not currently engaged and thus not contributing to a current pumping rate of the pumping system, and zero or more second pumps currently engaged and thus collectively providing the current pumping rate of the pumping system, and wherein coordinating the distribution of flow rates comprises:

determining (574) that either:

the second pumps are not collectively able to provide a target pumping rate of the pumping system that is greater than the current pumping rate of the pumping system; or the first pumps are available for, collectively with the second pumps, contributing to the target pumping rate of the pumping system; and iteratively, until engaged ones of the first and second pumps are collectively able to provide the target pumping rate of the pumping system and no first pumps remain available:

determining (578) that a minimum rate of a next available one of the first pumps is not greater than a difference between the current and target pumping rates of the pumping system; and engaging (582) the next available first pump at its minimum rate.

7. The method of claim 1 wherein the pumps comprise zero or more first pumps not currently engaged and thus not contributing to a current pumping rate of the pumping system, and zero or more second pumps currently engaged and thus collectively providing the current pumping rate of the pumping system, and wherein coordinating the distribution of flow rates comprises:

determining (574, 604) that either:

the second pumps are not collectively able to provide a target pumping rate of the pumping system that is greater than the current pumping rate of the pumping system; or the first pumps are available for, collectively with the second pumps, contributing to the target pumping rate of the pumping system; and iteratively, until engaged ones of the first and second pumps are collectively able to provide the target pumping rate of the pumping system and no first pumps remain available:

determining (578) that a minimum rate of a next available one of the first pumps is greater than a difference between the current and target pumping rates of the pumping system;

determining (610) that the minimum rate of the next available first pump is achievable based on that minimum rate, the difference between the current and target pumping rates of the pumping system, and surplus rates of the engaged ones of the first and second pumps without shifting gearing associated with the engaged ones of the first and second pumps; and engaging (612) the next available first pump at its minimum rate.

8. The method of claim 1 wherein coordinating the distribution of flow rates comprises:

determining (574, 604) that currently engaged ones of the pumps are collectively able to provide a target pumping rate of the pumping system that is greater than the current pumping rate of the pumping system;

determining (624) that a difference between the current and target pumping rates of the pumping system can be split among the currently engaged ones of the pumps; and increasing (630) the current individual rates of the currently engaged ones of the pumps by corresponding amounts resulting from splitting the difference between the current and target pumping rates of the pumping system among the currently engaged ones of the pumps.

9. The method of claim 1 wherein coordinating the distribution of flow rates comprises:

determining (574, 604) that currently engaged ones of the pumps are collectively able to provide a target pumping rate of the pumping system that is greater than the current pumping rate of the pumping system, and determining (624) that a difference between the current and target pumping rates of the pumping system cannot be split among the currently engaged ones of the pumps, and determining (652) the maximum number of non-engaged ones of the pumps by which the sum of the individual minimum rates of the non-engaged pumps and the individual minimum rates of the engaged pumps, collectively, is not greater than the target pumping rate of the pumping system; then either:

determining (656) that the sum of the maximum rates of the non-engaged pumps associated with their lowest gear is not less than the target pumping rate of the pumping system, and consequently:

engaging the non-engaged pumps as new pumps; and adjusting (658) the rates of all engaged pumps to distribute the target pumping rate of the pumping system substantially evenly among all engaged pumps with each in the lowest gear; or determining (656) that the sum of the maximum rates of the non-engaged pumps associated with their lowest gear is less than the target pumping rate of the pumping system, and consequently:

determining (660) minimum rate gaps of the non-engaged pumps associated with their two lowest gears; and either:

determining (662) that the difference between the target pumping rate of the pumping system and the sum of the maximum rates of the non-engaged pumps associated with their lowest gear is not less than the determined minimum rate gaps, and consequently:

engaging (666) the non-engaged pumps as new pumps at their minimum rates; and then shifting (668) transmissions of all engaged pumps to their second lowest gears; or determining (662) that the difference between the target pumping rate of the pumping system and the sum of the maximum rates of the non-engaged pumps associated with their lowest gear is less than the determined minimum rate gaps, and consequently:

engaging (666) all but one of the non-engaged pumps as new pumps at their minimum rates; and then shifting (668) transmissions of all engaged pumps to their second lowest gears; then upshift the transmission of each new pump one at a time and one gear at a time, such that each new pump transmission is no more than one gear different than the other new pumps, until the target pumping rate of the pumping system can be achieved with all of the engaged pumps at their then-minimum rates; and then increasing the rates of the lower-geared one or more of the new pumps until the target pumping rate of the pumping system is achieve.

10. The method of claim 1 wherein one of the pumps is a group of pumps operated at substantially the same rate and the same gearing.

11. A method (500) comprising:

generating (502) an operating order of pumps (150) of a pumping system (135) for performing a pumping operation;

determining (528) that a pump order list does not include enough pumps for pumping fluid for the pumping operation; and then iteratively, until the pump order list includes enough pumps for pumping fluid for the pumping operation:

identifying (530) a next one of the pumps that is not on the pump order list and that is available for pumping fluid for the pumping operation; and adding (532) the identified next available pump to the end of the then-current pump order list; and coordinating (504) distribution of flow rates to the pumps for performing the pumping operation.

12. The method of claim 11 wherein determining that the pump order list does not include enough pumps for pumping fluid for the pumping operation comprises comparing cumulative flow rates possible with the pumps on the pump order list to a target flow rate of the pumping system for performing the pumping operation.

13. The method of claim 11 wherein identifying the next available pump comprises identifying, from among the pumps that are not on the pump order list and that are available for pumping fluid, which pump is physically located closest to a predetermined component of a wellsite system (100) comprising the pumping system.

14. The method of claim 11 wherein the pumping operation is a first pumping operation, wherein the fluid is a first fluid, and wherein generating the operating order further comprises, before determining that the pump order list does not include enough pumps:

determining (520) that the pump order list does not include enough pumps for pumping a second fluid for at least one second pumping operation associated with the first pumping operation; and then iteratively, until the pump order list includes enough pumps for pumping the second fluid for the at least one second pumping operation:

identifying (522) a next one of the pumps that is not on the pump order list and that is available for pumping the second fluid for the at least one second pumping operation; and adding (524) the identified next available second-fluid pump to the end of the then-current pump order list.

15. The method of claim 11 wherein the pumps comprise zero or more first pumps not currently engaged and thus not contributing to a current pumping rate of the pumping system, and zero or more second pumps currently engaged and thus collectively providing the current pumping rate of the pumping system, and wherein coordinating the distribution of flow rates comprises:

determining (574) that either:

the second pumps are not collectively able to provide a target pumping rate of the pumping system that is greater than the current pumping rate of the pumping system; or the first pumps are available for, collectively with the second pumps, contributing to the target pumping rate of the pumping system; and iteratively, until engaged ones of the first and second pumps are collectively able to provide the target pumping rate of the pumping system and no first pumps remain available:

determining (578) that a minimum rate of a next available one of the first pumps is not greater than a difference between the current and target pumping rates of the pumping system; and engaging (582) the next available first pump at its minimum rate.

16. The method of claim 11 wherein the pumps comprise zero or more first pumps not currently engaged and thus not contributing to a current pumping rate of the pumping system, and zero or more second pumps currently engaged and thus collectively providing the current pumping rate of the pumping system, and wherein coordinating the distribution of flow rates comprises:

determining (574, 604) that either:

the second pumps are not collectively able to provide a target pumping rate of the pumping system that is greater than the current pumping rate of the pumping system; or the first pumps are available for, collectively with the second pumps, contributing to the target pumping rate of the pumping system; and iteratively, until engaged ones of the first and second pumps are collectively able to provide the target pumping rate of the pumping system and no first pumps remain available:

determining (578) that a minimum rate of a next available one of the first pumps is greater than a difference between the current and target pumping rates of the pumping system;

determining (610) that the minimum rate of the next available first pump is achievable based on that minimum rate, the difference between the current and target pumping rates of the pumping system, and surplus rates of the engaged ones of the first and second pumps without shifting gearing associated with the engaged ones of the first and second pumps; and engaging (612) the next available first pump at its minimum rate.

17. The method of claim 11 wherein coordinating the distribution of flow rates comprises:

determining (574, 604) that currently engaged ones of the pumps are collectively able to provide a target pumping rate of the pumping system that is greater than the current pumping rate of the pumping system;

determining (624) that a difference between the current and target pumping rates of the pumping system can be split among the currently engaged ones of the pumps; and increasing (630) the current individual rates of the currently engaged ones of the pumps by corresponding amounts resulting from splitting the difference between the current and target pumping rates of the pumping system among the currently engaged ones of the pumps.

18. The method of claim 11 wherein one of the pumps is a group of pumps operated at substantially the same rate and the same gearing.

* * * * *